US007832498B2

(12) United States Patent
Sugiyama et al.

(10) Patent No.: US 7,832,498 B2
(45) Date of Patent: Nov. 16, 2010

(54) IMPACT TOOL

(75) Inventors: Yoshio Sugiyama, Anjo (JP); Hiroki Ikuta, Anjo (JP)

(73) Assignee: Makita Corporation, Anjo-shi (JP)

( * ) Notice: Subject to any disclaimer, the term of this patent is extended or adjusted under 35 U.S.C. 154(b) by 33 days.

(21) Appl. No.: 12/155,902

(22) Filed: Jun. 11, 2008

(65) Prior Publication Data

US 2008/0308287 A1 Dec. 18, 2008

(30) Foreign Application Priority Data

Jun. 15, 2007 (JP) ..... 2007-159152
Jun. 15, 2007 (JP) ..... 2007-159166

(51) Int. Cl.
*B25D 17/00* (2006.01)

(52) U.S. Cl. ..... 173/162.1; 173/100; 173/211; 173/128

(58) Field of Classification Search ..... 173/210, 173/211, 100, 109, 117, 128, 132, 162.1
See application file for complete search history.

(56) References Cited

U.S. PATENT DOCUMENTS

| | | | | |
|---|---|---|---|---|
| 2,875,731 | A * | 3/1959 | Settles et al. | 267/137 |
| 4,279,091 | A * | 7/1981 | Edwards | 42/1.06 |
| 4,478,293 | A * | 10/1984 | Weilenmann et al. | 173/162.2 |
| 5,678,641 | A * | 10/1997 | Manschitz et al. | 173/114 |
| 5,775,441 | A | 7/1998 | Sakuragi et al. | |
| 5,850,884 | A * | 12/1998 | Rodger et al. | 173/91 |
| 6,763,897 | B2 * | 7/2004 | Hanke et al. | 173/210 |
| 7,252,157 | B2 * | 8/2007 | Aoki | 173/162.2 |
| 7,523,791 | B2 * | 4/2009 | Aoki | 173/210 |
| 2006/0289185 | A1 * | 12/2006 | Hahn | 173/210 |
| 2007/0017684 | A1 * | 1/2007 | Stirm et al. | 173/109 |
| 2007/0175647 | A1 * | 8/2007 | Aoki | 173/210 |
| 2008/0029282 | A1 | 2/2008 | Ikuta | |

(Continued)

FOREIGN PATENT DOCUMENTS

CN 1382562 A 12/2002

(Continued)

OTHER PUBLICATIONS

Mar. 22, 2010 European Search Report for European Patent Application No. 08010832.7.

*Primary Examiner*—Paul R Durand
(74) *Attorney, Agent, or Firm*—Oliff & Berridge, PLC

(57) ABSTRACT

It is an object of the invention to provide a technique for further improving the vibration reducing performance in an impact tool. A representative impact tool includes a tool body, a cylinder housed within the tool body, a dynamic vibration reducer having a weight that linearly moves under a biasing force of an elastic element, wherein the dynamic vibration reducer reduces vibration of the tool body during hammering operation by the movement of the weight in the axial direction of the tool bit, and a mechanical vibration mechanism that actively drives the weight by applying external force other than vibration of the tool body to the weight via the elastic element. The weight and the elastic element are disposed on the axis of the tool bit and between an inner wall surface of the tool body and an outer wall surface of the cylinder in such a manner as to cover at least part of the outer wall surface of the cylinder in the circumferential direction.

5 Claims, 17 Drawing Sheets

U.S. PATENT DOCUMENTS

2009/0236113 A1* 9/2009 Gumpert et al. ..... 173/210

FOREIGN PATENT DOCUMENTS

| | | | |
|---|---|---|---|
| CN | 1915606 | A | 2/2007 |
| EP | 1 179 979 | A1 | 2/2002 |
| EP | 1 252 976 | A1 | 10/2002 |
| EP | 1 437 200 | A1 | 7/2004 |
| EP | 1 627 708 | A1 | 2/2006 |
| EP | 1 754 575 | A2 | 2/2007 |
| JP | A-08-318343 | | 12/1996 |
| WO | WO 2004/082897 | A1 | 9/2004 |
| WO | WO 2005/105386 | A1 | 11/2005 |

* cited by examiner

IMPACT TOOL

BACKGROUND OF THE INVENTION

1. Field of the Invention

The present invention relates to a vibration reducing technique in an impact tool which drives a tool bit, such as a hammer and a hammer drill.

2. Description of the Related Art

WO2005/105386 discloses an electric hammer having a vibration reducing mechanism. The known hammer has a dynamic vibration reducer, wherein a crank mechanism is utilized to actively drive a weight of the dynamic vibration reducer to reduce vibration caused during hammering operation.

SUMMARY OF THE INVENTION

It is an object of the invention to provide a technique for further improving the vibration reducing performance in an impact tool.

Above-mentioned object can be achieved by a claimed invention. A representative impact tool performs a predetermined hammering operation on a workpiece by a striking movement of a tool bit in its axial direction. The representative impact tool includes a tool body, a cylinder housed within the tool body, a dynamic vibration reducer and a mechanical vibration mechanism. The "predetermined hammering operation" in this invention suitably includes not only a hammering operation in which the tool bit performs only a striking movement in its axial direction, but a hammer drill operation in which it performs a striking movement in its axial direction and a rotation around its axis. The dynamic vibration reducer in this invention has a weight that can linearly move under a biasing force of an elastic element, and the dynamic vibration reducer reduces vibration of the tool body during hammering operation by the movement of the weight in the axial direction of the tool bit. It is at least necessary for the weight as an element of the dynamic vibration reducer to be acted upon by the biasing force of the elastic element. The weight may further be acted upon by a damping force of a damping element. The "elastic element" in this invention typically comprises a spring. The mechanical vibration mechanism actively drives the weight by applying external force other than vibration of the tool body to the weight via the elastic element. By thus actively driving the weight via the mechanical vibration mechanism and forcibly vibrating the dynamic vibration reducer, the dynamic vibration reducer can be steadily actuated regardless of the magnitude of vibration on the impact tool.

According to the preferred embodiment of the present invention, the weight and the elastic element are disposed on the axis of the tool bit and between an inner wall surface of the tool body and an outer wall surface of the cylinder in such a manner as to cover at least part of the outer wall surface of the cylinder in the circumferential direction. The manner of "covering at least part of the outer wall surface of the cylinder in the circumferential direction" widely includes, as for the weight, the manner in which the weight has a cylindrical body which is circular, elliptical or polygonal in section and covers the entire outer wall surface of the cylinder in the circumferential direction, and the manner in which the weight has a cylindrical body which has a cut in part in the circumferential direction, such as a body generally C-shaped in section, and as for the elastic element, it represents the manner in which a coil spring is annularly disposed outside the cylinder.

According to this invention, with the construction in which the weight and the elastic element that form the dynamic vibration reducer are disposed between the inner wall surface of the tool body and the outer wall surface of the cylinder, the centers of gravity of the weight and the elastic element can be placed substantially on the axis of the tool bit. As a result, a couple, or force of rotation around an axis extending transverse to the axial direction of the tool bit, can be prevented from being generated when the weight moves in the axial direction of the tool bit. Moreover, according to this invention, the existing space can be utilized to dispose the vibration reducing mechanism, which is effective in reducing the size of the impact tool.

According to a further embodiment of the present invention, the impact tool further includes an actuating mechanism that linearly drives the tool bit. The actuating mechanism includes a motor, a striking element that linearly moves in the axial direction of the tool bit in such a manner as to cause the tool bit to linearly move, and a first crank mechanism that converts a rotating output of the motor into linear motion and thereby drives the striking element. The mechanical vibration mechanism includes a sliding element that linearly moves in the axial direction of the tool bit in such a manner as to apply an external force to the elastic element and a second crank mechanism that converts rotation of the first crank mechanism into linear motion and thereby drives the sliding element. Further, the second crank mechanism is rotationally driven by the motor via the first crank mechanism.

According to this invention, both the striking element and the sliding element can be driven by the single motor, and thus a rational driving system can be provided.

According to a further embodiment of the present invention, the impact tool further includes an opening that is formed in the tool body and provided as a hole through which the first crank mechanism is mounted within the tool body, and a covering member that can be mounted on the opening from outside the tool body in such a manner as to close the opening. The first crank mechanism has a crank shaft that is rotatably disposed within the tool body and faces the opening. The second crank mechanism has a crank shaft that is rotatably mounted to the covering member and opposed to the crank shaft of the first crank mechanism. A concave portion is formed in one of opposed ends of the crank shafts of the first and second crank mechanisms, and a convex portion is formed on the other of the opposed ends of the crank shafts and can engage with the concave portion. When the covering member is mounted on the opening, the crank shaft of the first crank mechanism and the crank shaft of the second crank mechanism are interconnected by engagement between the concave portion and the convex portion such that rotation of the crank shaft of the first crank mechanism can be transmitted to the crank shaft of the second crank mechanism. The manner of being "opposed" in this invention preferably represents the manner of being opposed substantially on the same axis.

According to this invention, the second crank mechanism is mounted on the covering member for closing the opening, and when the covering member is mounted on the opening, the crank shaft of the first crank mechanism and the crank shaft of the second crank mechanism are interconnected by engagement between the concave portion and the convex portion such that rotation can be transmitted. With this construction, by mounting the second crank mechanism on the covering member in advance and then fitting the covering member over the opening, the second crank mechanism can be easily mounted on the first crank mechanism. Thus, ease of assembly can be increased. The opening formed in the tool body is designed and provided as a hole through which the first crank mechanism is mounted within the tool body. Further, an upper region above the first crank mechanism exists as free space. According to this invention, the second crank mechanism can be disposed by utilizing this free space. Thus, the second crank mechanism can be installed without changing the outside dimensions of the existing impact tool.

According to a further embodiment of the present invention, the weight is disposed on the tool body such that the weight can move along the inner wall surface of the tool body in the axial direction of the tool bit. With this construction, the linear movement of the weight along the inner wall surface of the tool body can be stabilized. Further, the weight and the elastic element which are disposed on the tool body side can be arranged out of contact with the outer wall surface of the cylinder. Therefore, if such a construction is applied to an impact tool of the type, for example, in which the striking element is driven via pressure fluctuations of air within the cylinder and strikes the tool bit, the weight can be avoided from having an adverse effect on the air vent which is formed in the cylinder in order to provide communication between the air chamber and the outside.

Further, as another aspect of the invention, a representative impact tool may include a tool body, a cylinder housed within the tool body, a driving element that linearly moves in the axial direction of the tool bit within the cylinder, a striking element that linearly moves in the axial direction of the tool bit within the cylinder, and an air chamber defined between the driving element and the striking element within the cylinder. The striking element is caused to linearly move via pressure fluctuations of the air chamber as a result of the linear movement of the driving element and strikes the tool bit, whereby the predetermined hammering operation is performed on the workpiece.

Further, the impact tool may further include a ventilation part that is formed in the cylinder and provides communication between the air chamber and the outside in order to regulate pressure of the air chamber so as to achieve smooth movement of the striking element, and a ventilation part opening-closing member that is disposed outside the cylinder and can slide in the axial direction of the tool bit. During hammering operation by the tool bit, the ventilation part opening-closing member controls opening and closing of the ventilation part by moving between an open position for opening the ventilation part and a closed position for closing the ventilation part at a predetermined timing.

According to the invention, with the construction in which the ventilation part opening-closing member is disposed outside the cylinder and controls opening and closing of the ventilation part, the timing of opening and closing the ventilation part, or the time at which the ventilation part is switched from the closed position to the open position during striking movement of the striking element and the time at which the ventilation part is switched from the open position to the closed position during suction of the striking element, can be arbitrarily adjusted in the relationship with the position of the striking element. Specifically, according to this invention, the ventilation part can be opened only when necessary. As a result, the pressure of the air chamber can be controlled such that, during striking movement of the striking element, optimum striking speed is provided for the striking element, and during suction of the striking element, optimum suction force acts upon the striking element.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment of the Invention

Figure 1:
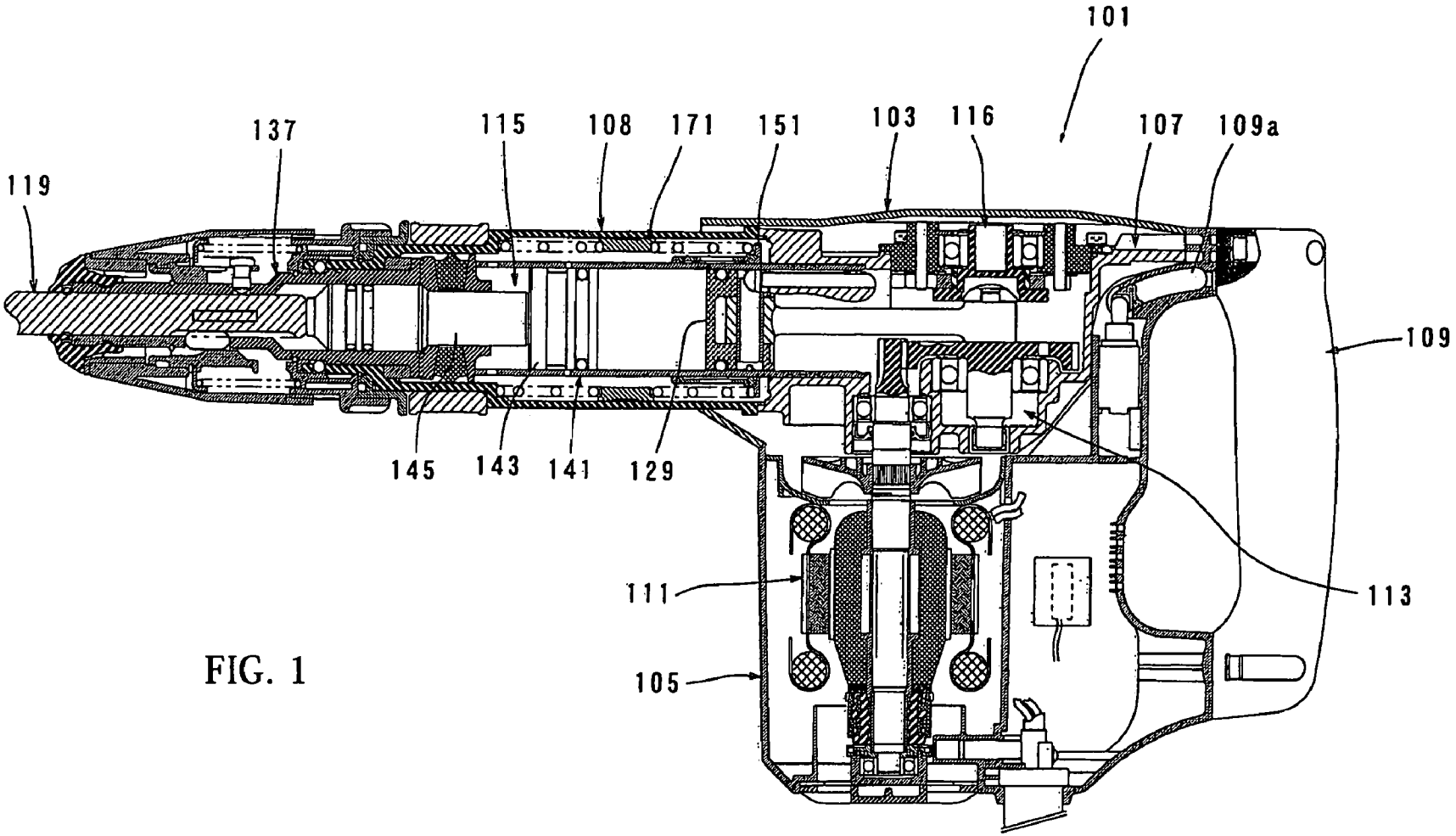
FIG. 1 is a sectional side view schematically showing an entire electric hammer according to a first embodiment of this invention.
Figure 2:
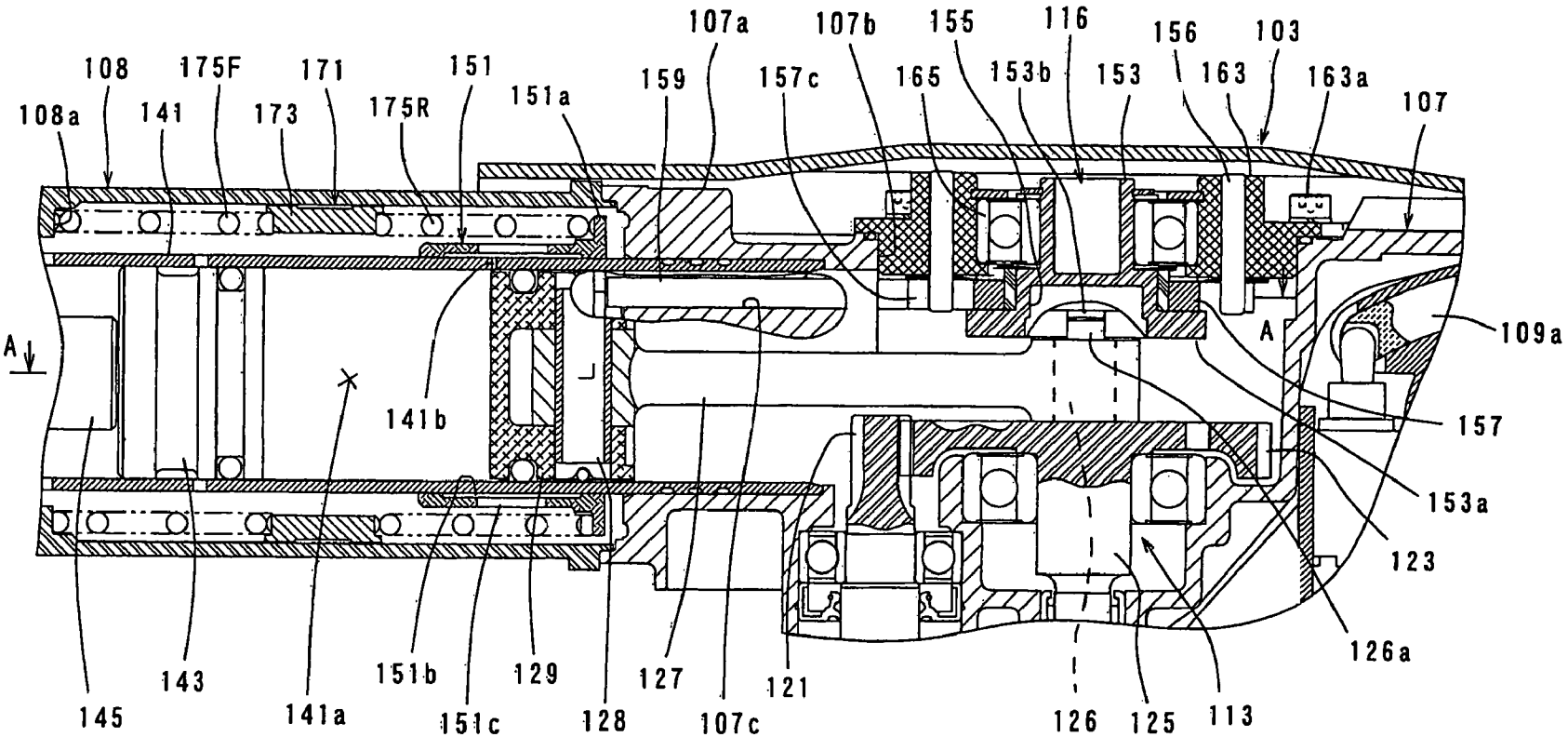
FIG. 2 is an enlarged sectional view showing an essential part of the hammer in the state in which a slide sleeve is substantially in an intermediate position.
Figure 3:
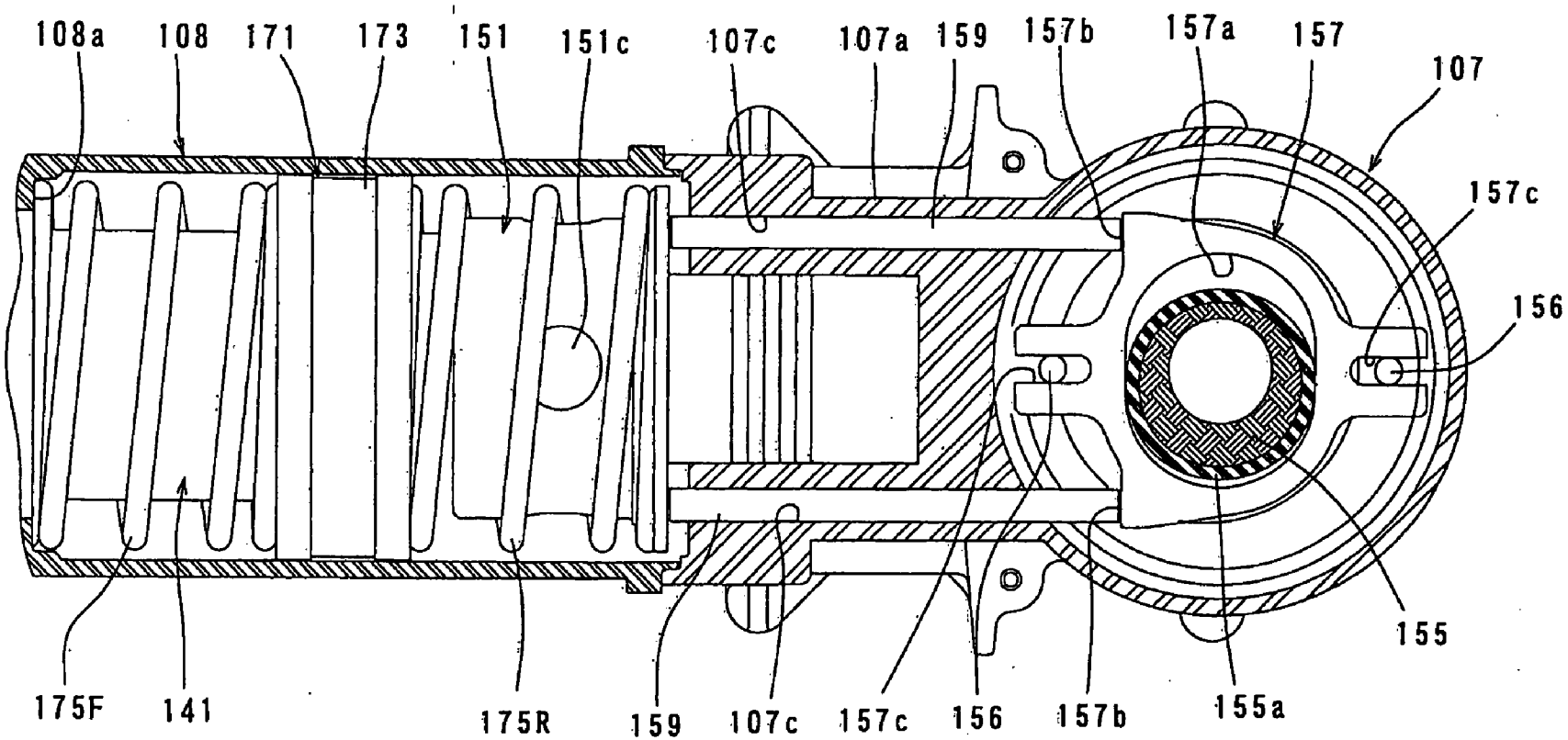
FIG. 3 is a sectional view taken along line A-A in FIG. 2.
Figure 4:
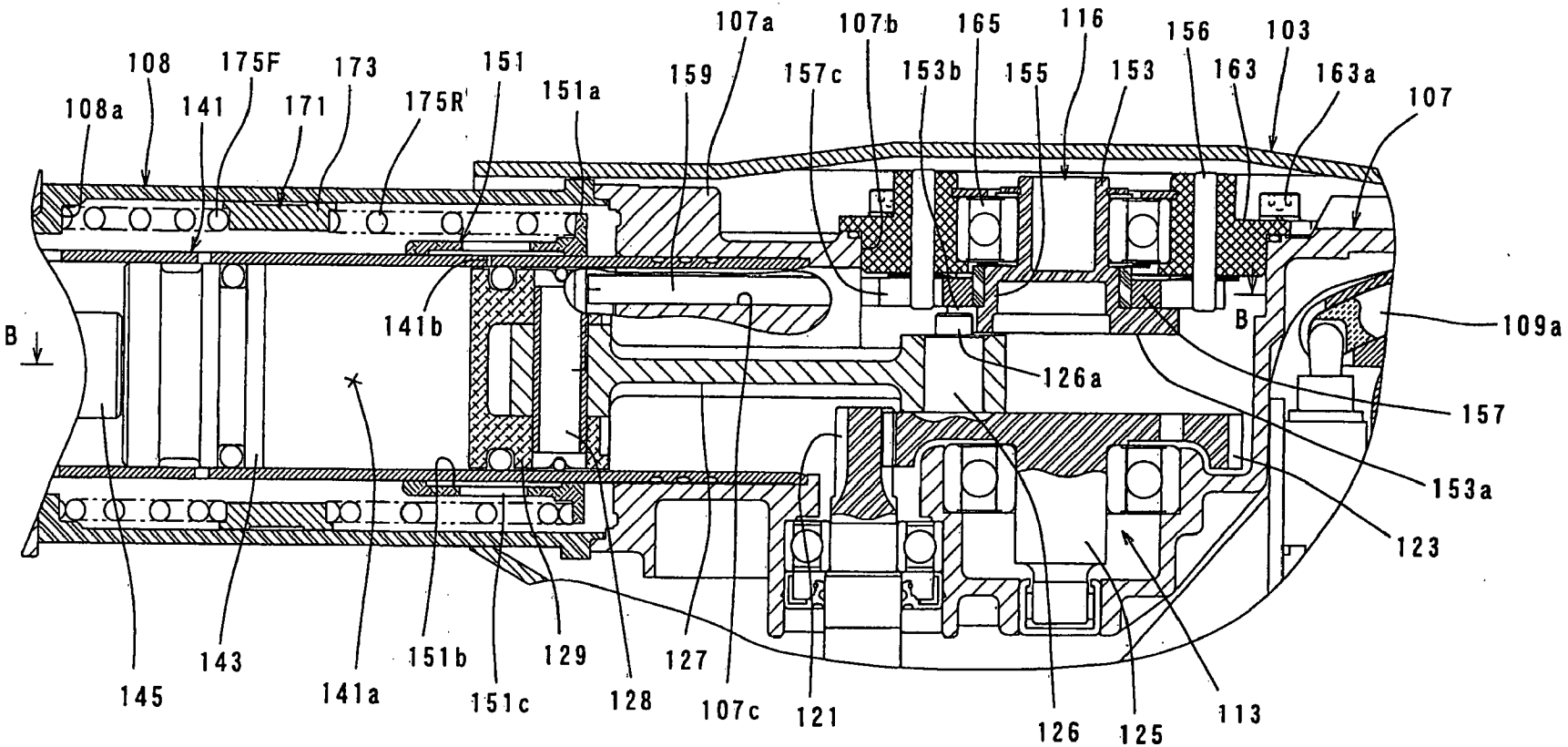
FIG. 4 is an enlarged sectional view showing the essential part of the hammer in the state in which the slide sleeve is in a front end position.
Figure 5:
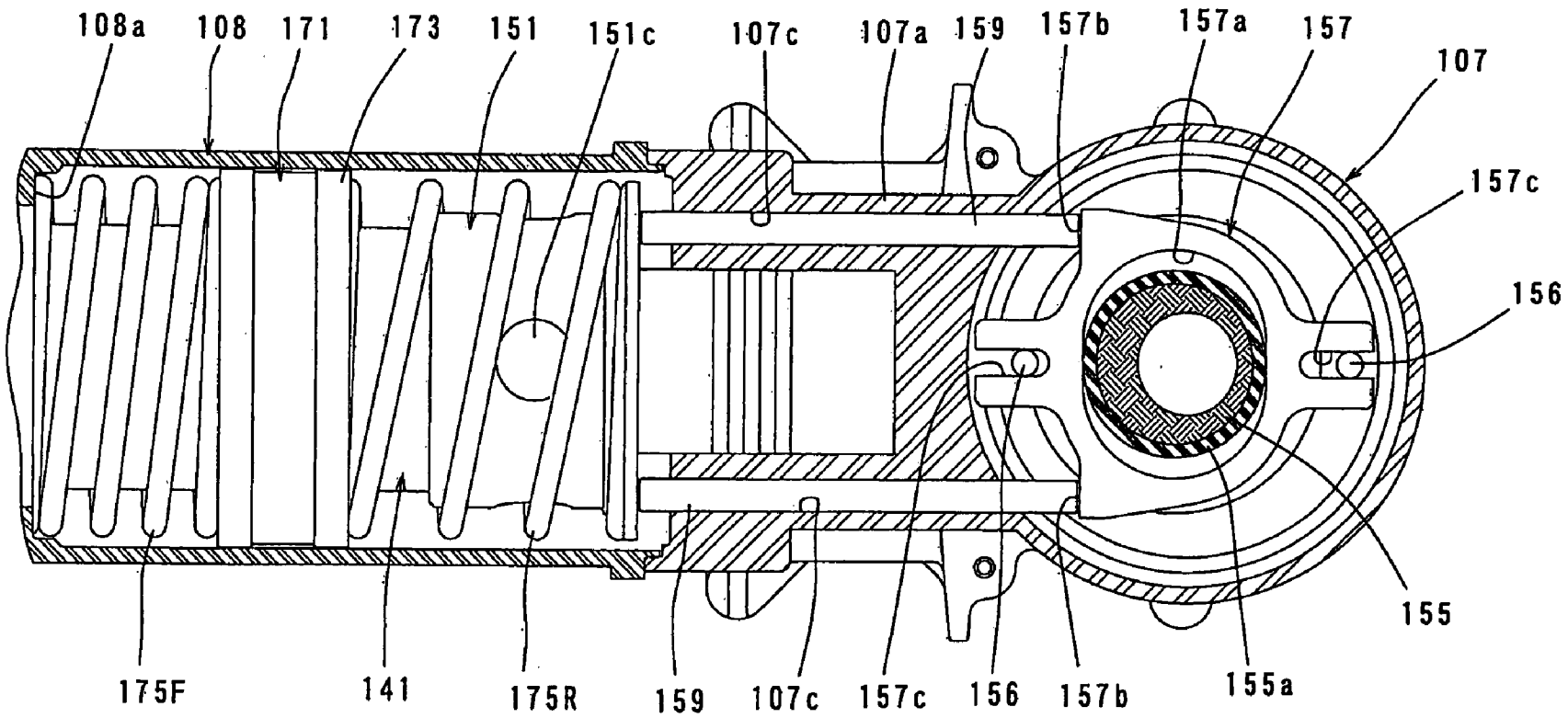
FIG. 5 is a sectional view taken along line B-B in FIG. 4.
Figure 6:
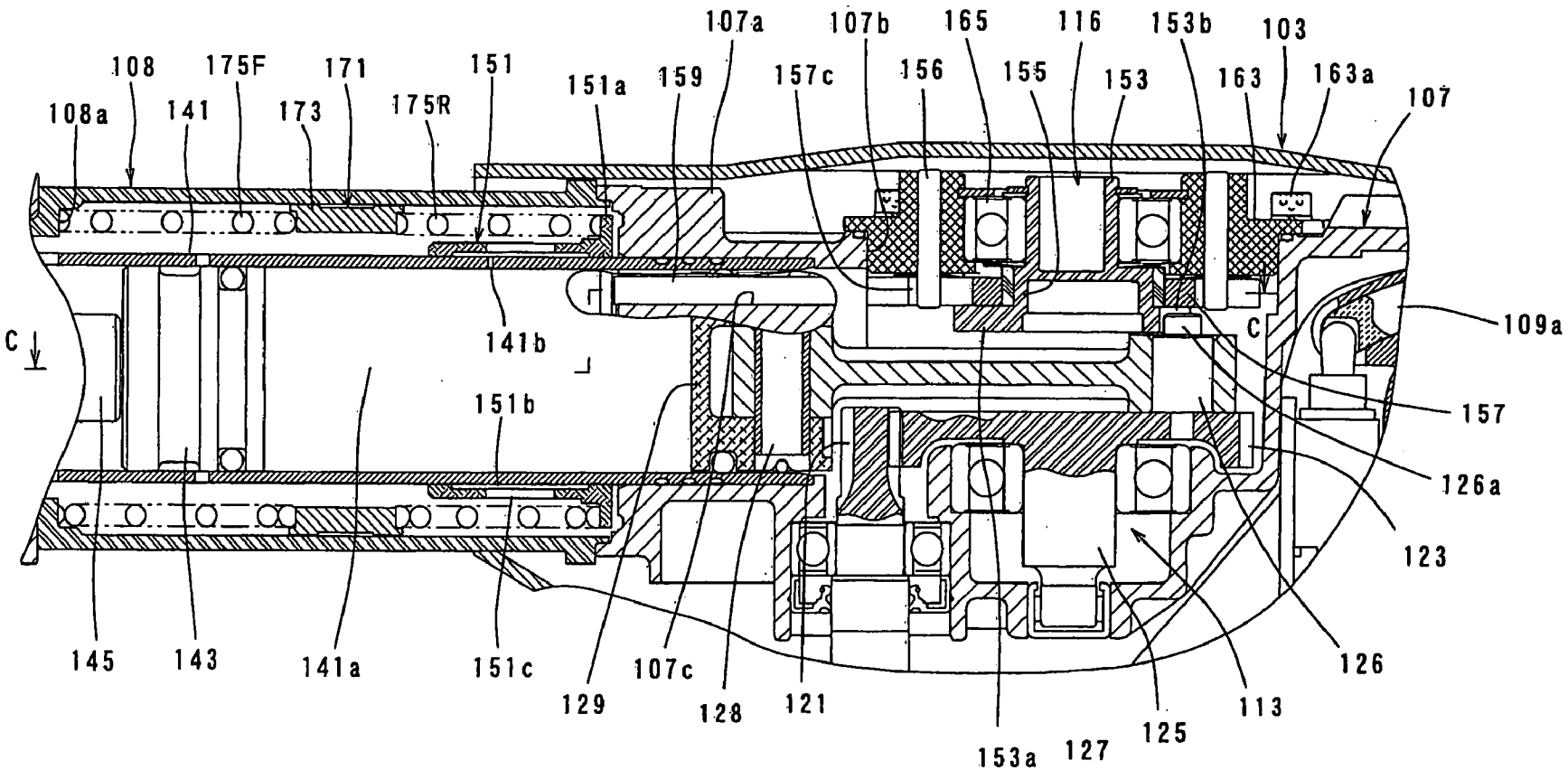
FIG. 6 is an enlarged sectional view showing the essential part of the hammer in the state in which the slide sleeve is in a rear end position.
Figure 7:
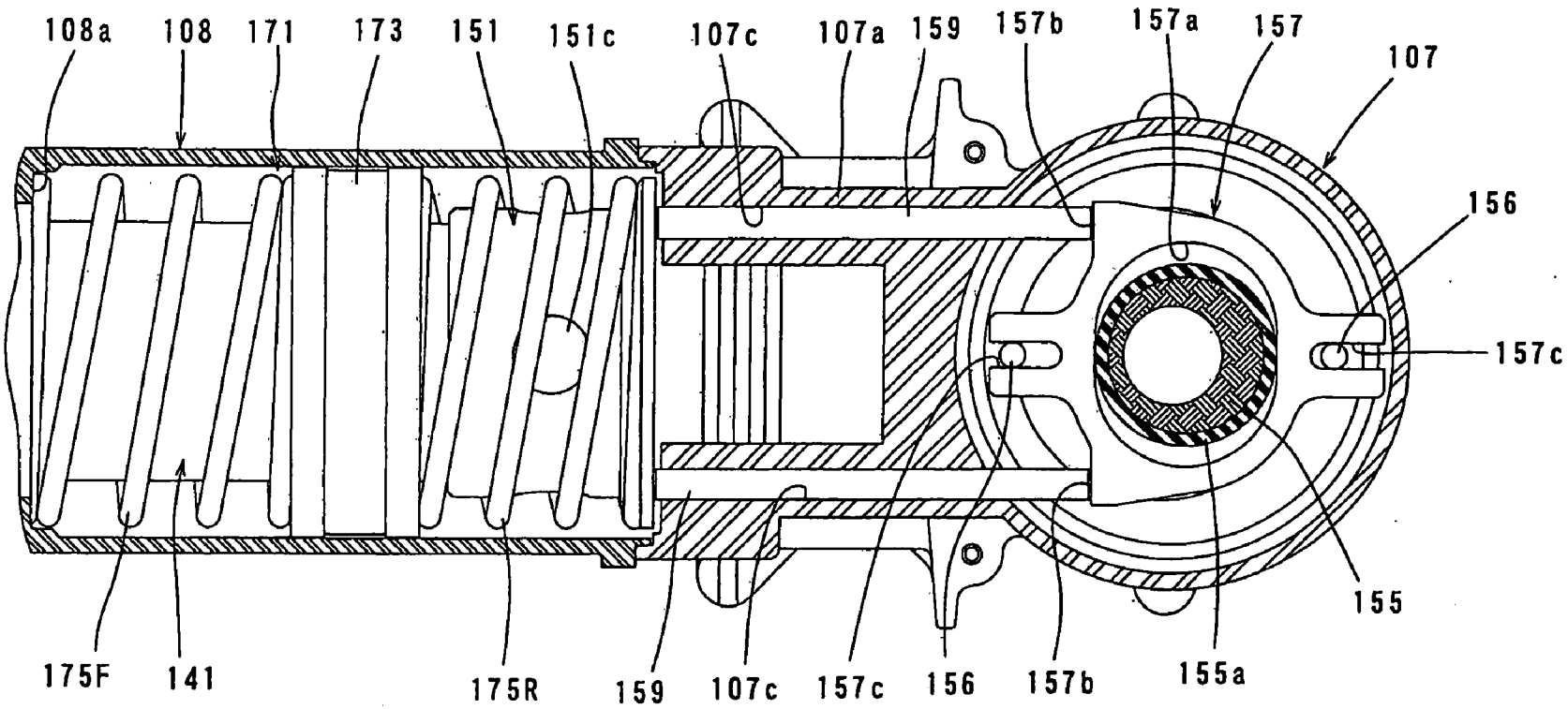
FIG. 7 is a sectional view taken along line C-C in FIG. 6.

A first embodiment of the present invention is now described with reference to FIGS. 1 to 7. FIG. 1 shows an entire electric hammer 101 as a representative embodiment of the impact tool according to the present invention. FIGS. 2, 4 and 6 are enlarged sectional views each showing an essential part of the hammer. FIG. 2 shows the state in which a slide sleeve for forcibly moving a dynamic vibration reducer is substantially in an intermediate position. FIGS. 4 and 5 show the state in which the slide sleeve is in a front end position, and FIGS. 6 and 7 show the state in which the slide sleeve is in a rear end position.

As shown in FIG. 1, the hammer 101 of this embodiment includes a body 103, a hammer bit 119 detachably coupled to the tip end region (on the left side as viewed in FIG. 1) of the body 103 via a tool holder 137, and a handgrip 109 that is connected to the body 103 on the side opposite the hammer bit 119 and designed to be held by a user. The body 103 and the hammer bit 119 are features that correspond to the "tool body" and the "tool bit", respectively, according to the present invention. The hammer bit 119 is held by the tool holder 137 such that it is allowed to reciprocate with respect to the tool holder 137 in its axial direction and prevented from rotating with respect to the tool holder 137 in its circumferential direction. In the present embodiment, for the sake of convenience of explanation, the side of the hammer bit 119 is taken as the front side and the side of the handgrip 109 as the rear side.

The body 103 includes a motor housing 105 that houses a driving motor 111, and a gear housing 107 that houses a first motion converting mechanism 113 and a second motion converting mechanism 116, and a barrel housing 108 that houses a striking mechanism 115. The rotating output of the driving motor 111 is appropriately converted into linear motion via the first motion converting mechanism 113 and transmitted to the striking element 115. Then, an impact force is generated in the axial direction of the hammer bit 119 via the striking element 115. Further, the rotating output of the driving motor 111 is transmitted to the second motion converting mechanism 116 via the first motion converting mechanism 113 and converted into linear motion by the second motion converting mechanism 116. The linear motion then serves as a driving force for forcibly vibrating a dynamic vibration reducer 171 which will be described below. The first motion converting mechanism 113 and the striking mechanism 115 are features that correspond to the "actuating mechanism", and the second motion converting mechanism 116 corresponds to the "mechanical vibration mechanism" according to this invention. The driving motor 111 is a feature that corresponds to the "motor" according to this invention. Further, a slide switch 109*a* is provided on the handgrip 109 and can be slid by the user to drive the driving motor 111.

As shown in FIG. 2, the first motion converting mechanism 113 includes a driving gear 121 that is rotated in a horizontal plane by the driving motor 111 (see FIG. 1), a first crank shaft 125 integrally having a driven gear 123 that engages with the driving gear 121, a connecting member in the form of a crank arm 127 that is loosely connected at its one end to the first crank shaft 125 via an eccentric pin 126 in a position displaced a predetermined distance from the center of rotation of the first crank shaft 125, and a driving element in the form of a piston 129 mounted to the other end of the crank arm 127 via a connecting shaft 128. The first crank shaft 125, the eccentric pin 126, the crank arm 127 and the piston 129 form a first crank mechanism.

The striking mechanism 115 includes a striking element in the form of a striker 143 that is slidably disposed within the bore of the cylinder 141, and an intermediate element in the form of an impact bolt 145 that is slidably disposed within the tool holder 137 and transmits the kinetic energy of the striker 143 to the hammer bit 119. An air chamber 141*a* is defined between the piston 129 and the striker 143 within the cylinder 141. The striker 143 is driven via the action of an air spring of the air chamber 141*a* of the cylinder 141 which is caused by sliding movement of the piston 129. The striker 143 then collides with (strikes) the intermediate element in the form of the impact bolt 145 that is slidably disposed within the tool holder 137 and transmits the striking force to the hammer bit 119 via the impact bolt 145. The cylinder 141 is disposed coaxially with the hammer bit 119. Therefore, the piston 129 and the striker 143 linearly move on the same axis as the hammer bit 119. Further, the cylinder 141 is inserted from the front into the bore of a cylindrical cylinder holding portion 107*a* formed in the front region of the gear housing 107 and held there, and is housed within the barrel housing 108 joined to the gear housing 107.

The dynamic vibration reducer 171 that reduces vibration of the body 103 during hammering operation and the second motion converting mechanism 116 that forcibly vibrates the dynamic vibration reducer 171 by actively driving a weight 173 of the dynamic vibration reducer 171 will now be described. In this specification, forcibly vibrating the dynamic vibration reducer 171 is referred to as forced vibration. The dynamic vibration reducer 171 is provided in the inner space of the barrel housing 108 and mainly includes a cylindrical weight 173 annularly arranged outside the cylinder 141 and front and rear biasing springs 175F, 175R disposed on the front and rear sides of the weight 173 in the axial direction of the hammer bit. The biasing springs 175F, 175R are features that correspond to the "elastic element" according to this invention. The front and rear biasing springs 175F, 175R exert a spring force on the weight 173 in a direction toward each other when the weight 173 moves in the axial direction of the hammer bit 119.

The weight 173 is arranged such that its center (of gravity) coincides with the axis of the hammer bit 119 and can freely slide with its outer wall surface held in contact with the inner wall surface (cylindrical surface) of the barrel housing 108. Further, the front and rear biasing springs 175F, 175R are formed by compression coil springs and, like the weight 173, they are arranged such that each of their centers coincides with the axis of the hammer bit 119. One end (rear end) of the rear biasing spring 175R is held in contact with a front surface of the flange 151*a* of the slide sleeve 151, while the other end (front end) is held in contact with the axial rear end of the weight 173. Further, one end (rear end) of the front biasing spring 175F is held in contact with the axial front end of the weight 173, while the other end (front end) is held in contact with a stepped surface 108*a* of the barrel housing 108.

The slide sleeve 151 forms an input member that inputs the driving force of the second motion converting mechanism 116 into the weight 173 via the rear biasing spring 175R. The slide sleeve 151 is fitted on the cylinder 141 such that it can slide in the axial direction of the hammer bit, and the slide sleeve 151 is slid by the second motion converting mechanism 116. The slide sleeve 151 is a feature that corresponds to the "sliding element" according to this invention. An air vent 141*b* is formed in the cylinder 141 in order to regulate pressure of the air chamber 141*a* and provides communication between the air chamber 141*a* and the outside. In order to prevent the slide sleeve 151 fitted on the cylinder 141 from always closing the air vent 141*b*, the slide sleeve 151 includes an annular space 151*b* that always communicates with the air vent 141*b*, and a plurality of communication holes 151*c* that radially extend through the slide sleeve 151 and provide communication between the space 151*b* and the outside.

The second motion converting mechanism 116 is disposed above the first motion converting mechanism 113. As shown in FIGS. 2 to 7, the second motion converting mechanism 116 mainly includes a second crank shaft 153 that is rotationally driven in a horizontal plane by rotation of the eccentric pin 126 of the first motion converting mechanism 113, an eccentric shaft portion 155 integrally formed with the second crank shaft 153, a connecting plate 157 that is caused to reciprocate in the axial direction of the hammer bit by rotation of the eccentric shaft portion 155, and an actuating member in the form of right and left straight rods 159 that linearly move together with the connecting plate 157 and moves the slide sleeve 151 forward. The second crank shaft 153, the eccentric shaft portion 155 and the connecting plate 157 form the second crank mechanism which is a feature that corresponds to the "second crank mechanism" according to this invention.

The second crank shaft 153 is coaxially opposed to the first crank shaft 125. The second crank shaft 153 has a disk-like portion 153*a* on its axial lower end. A recess (groove) 153*b* is formed in the lower surface of the disk-like portion 153*a* in a position displaced from the center of rotation of the second crank shaft 153. The recess 153*b* is engaged with a protruding end 126*a* of the eccentric pin 126 of the first motion converting mechanism 113. The recess 153*b* and the protruding end 126*a* are features that correspond to the "concave portion" and the "convex portion", respectively, according to this invention. Specifically, the second crank shaft 153 is rotationally driven by a driving force that is inputted from the first crank shaft 125 via engagement between the recess 153*b* and the protruding end 126. An opening 107*b* to be used for mounting the first motion converting mechanism 113 is formed in the gear housing 107 above the first motion converting mechanism 113. The second crank mechanism is mounted on a crank cap 163 which is removably fitted over the opening 107*b*. The crank cap 163 is a feature that corresponds to the "covering member" according to this invention.

The second crank shaft 153 is rotatably supported on the crank cap 163 via a bearing 165. The eccentric shaft portion 155 has a circular shape of which center is displaced a predetermined distance from the center of rotation of the second crank shaft 153. The connecting plate 157 is engaged with a ring 155*a* that is fitted on the eccentric shaft portion 155, via an elliptical hole 157*a* elongated in a direction transverse to the axial direction of the hammer bit. Further, the connecting plate 157 is guided by front and rear guide pins 156 mounted to the crank cap 163 in such a manner as to linearly move in the axial direction of the hammer bit. Further, front and rear guide grooves 157*c* are formed in the connecting plate 157 and extend in the axial direction of the hammer bit, and the guide grooves 157*c* are slidably engaged with the associated guide pins 156. As shown in FIG. 4, the right and left rods 159 are slidably fitted into respective guide holes 107*c* that are formed through the cylinder holding portion 107*a* of the gear housing 107 in the axial direction of the hammer bit. One axial end (rear end) of each of the rods 159 is held in contact with a planar front surface 157*b* of the connecting plate 157, while the other axial end (front end) is held in contact with a rear end surface of the slide sleeve 151.

The second crank shaft 153 and the connecting plate 157 which form the second crank mechanism are mounted to the crank cap 163 before the crank cap 163 is mounted on the opening 107*b* of the gear housing 107. The connecting plate 157 is held between the inner wall surface of the crank cap 163 and the disk-like portion 153*a* of the second crank shaft 153, so that the connecting plate 157 is prevented from moving in the axial direction of the second crank shaft 153 (in the vertical direction). The crank cap 163 with the second crank shaft 153 and the connecting plate 157 mounted thereto is fitted over the opening 107*b* from outside (above) the gear housing 107 and fastened to the gear housing 107 by a plurality of screws 163*a*. At this time, the recess 153*b* formed in the disk-like portion 153*a* of the second crank shaft 153 is engaged with the protruding end 126*a* of the eccentric pin 126 of the first crank mechanism which is already mounted within the gear housing 107, and the rear end of the rod 159 is brought into contact with the front surface 157*b* of the connecting plate 157. Thus, the first and second crank mechanisms are assembled in a mechanically interconnected manner such that the rotating force can be transmitted.

Operation of the hammer 101 having the above-described construction is now explained. When the driving motor 111 (shown in FIG. 1) is driven, the rotating output of the driving motor 111 causes the driving gear 121 to rotate in the horizontal plane. When the driving gear 121 rotates, the first crank shaft 125 revolves in the horizontal plane via the driven gear 123 that engages with the driving gear 121. Then, the piston 129 is caused to linearly slide within the cylinder 141 via the crank arm 127. Thus, the striker 143 reciprocates within the cylinder 141 and collides with (strikes) the impact bolt 145 by the action of the air spring function within the cylinder 141 as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on the workpiece.

During the above-mentioned hammering operation (when the hammer bit 119 is driven), impulsive and cyclic vibration is caused in the body 103 in the axial direction of the hammer bit. Main vibration of the body 103 which is to be reduced is a compressing reaction force which is produced when the piston 129 and the striker 143 compress air within the air chamber 141*a*, and a striking reaction force which is produced with a slight time lag behind the compressing reaction force when the striker 143 strikes the hammer bit 119 via the impact bolt 145.

In the dynamic vibration reducer 171 in this embodiment, the weight 173 and the biasing springs 175F, 175R serve as vibration reducing elements in the dynamic vibration reducer 171 and cooperate to passively reduce vibration of the body 103 of the hammer 101. Thus, the above-mentioned vibration which is caused in the body 103 of the hammer 101 can be effectively alleviated or reduced.

In some actual operation, a user strongly presses the hammer 101 against the workpiece, so that a considerable load is applied to the hammer bit 119 from the workpiece side. Therefore, although vibration reduction is highly required, the amount of vibration to be inputted to the dynamic vibration reducer 171 may be limited.

In such type of operation, vibration of the body 103 can be more effectively reduced by forced vibration of the dynamic vibration reducer 171. Specifically, in this embodiment, during hammering operation, when the first crank shaft 125 rotates, the second crank shaft 153 that is engaged with the protruding end 126*a* of the eccentric pin 126 via the recess 153*b* is caused to rotate at the same speed as the first crank shaft 125. When the eccentric shaft portion 155 of the second crank shaft 153 rotates in a horizontal plane, the connecting plate 157 engaged with the eccentric shaft portion 155 is caused to reciprocate in the axial direction of the hammer bit 119. When the connecting plate 157 moves forward, the slide sleeve 151 is pushed forward via the rods 159 and compresses the biasing springs 175F, 175R. On the other hand, when the connecting plate 157 moves rearward, the slide sleeve 151 is pushed rearward by the spring force of the biasing springs 175F, 175R. FIGS. 2 and 3 show the state in which the slide sleeve 151 that moves in the longitudinal direction is substantially in its intermediate position. FIGS. 4 and 5 show the state in which the slide sleeve 151 is in its front end position, and FIGS. 6 and 7 show the state in which the slide sleeve 151 is in its rear end position. Specifically, during hammering operation, the weight 173 of the dynamic vibration reducer 171 is actively driven via the biasing springs 175F, 175R and causes the dynamic vibration reducer 171 to be forcibly vibrated.

Thus, the dynamic vibration reducer 171 serves as an active vibration reducing mechanism in which the weight 173 is actively driven. Therefore, the vibration which is caused in the body 103 during hammering operation can be further effectively reduced or alleviated. As a result, a sufficient vibration reducing function can be ensured even in operations of the type in which, although vibration reduction is highly required, only a small amount of vibration is inputted to the dynamic vibration reducer 171 and the dynamic vibration reducer 171 does not sufficiently function, particularly, for example, in a hammering operation which is performed with the user's strong pressing force applied to the body 103 (force of pressing the hammer bit 119 against the workpiece).

In this embodiment, a spring receiving member in the form of the slide sleeve 151 is driven via the second crank mechanism which is formed by the eccentric shaft portion 155 and the connecting plate 157, and the weight 173 is actively driven via the rear biasing spring 175R. With this construction, the timing of driving the weight 173 with respect to the timing of driving the piston 129 (the striker 143) by the first crank mechanism, or the crank phase of the second crank mechanism, can be adjusted such that, when the striker 143 is caused to move forward via pressure fluctuations of the air chamber 141*a* and strikes the hammer bit 119 via the impact bolt 145, the weight 173 of the dynamic vibration reducer 171 counteracts impulsive vibration caused in the body 103 or linearly moves in a direction opposite to the intermediate region of either one or both of the above-mentioned compressing reaction force and the striking reaction force produced immediately after the compressing reaction force. As a result, the linear movement of the weight 173 can be timed to coincide with generation of a large amount of vibration during hammering operation, so that the vibration reducing function of the weight 173 can be performed in an optimum manner.

Further, in this embodiment, the weight 173 and the biasing springs 175F, 175R which form the dynamic vibration reducer 171 are annularly arranged outside the cylinder 141. With this construction, the space between the outer periphery of the cylinder 141 and the inner periphery of the barrel housing 108 can be effectively utilized to dispose the vibration reducing mechanism, which is effective in reducing the size of the electric hammer 101. Further, by the annular arrangement, the weight 173 and the biasing springs 175F, 175R can be disposed such that their centers of gravity are placed on the axis of the hammer bit 119. As a result, a couple (force of lateral or vertical rotation around an axis extending transverse to the axial direction of the hammer bit) can be prevented from acting upon the body 103 when the weight 173 reciprocates in the axial direction of the hammer bit 119.

Further, in this embodiment, the weight 173 is disposed such that it can slide in the axial direction of the hammer bit 119 along the inner wall surface of the barrel housing 108. With this construction, the sliding movement of the weight 173 can be stabilized. Further, the weight 173 can be disposed out of contact with the outer wall surface of the cylinder 141. Thus, the weight 173 can be avoided from having an adverse effect on the air vent 141*b* which is formed in the cylinder 141 in order to provide communication between the air chamber 141*a* and the outside.

Further, in this embodiment, the crank cap 163 is fitted over the opening 107*b* in order to close the opening 107*b* of the gear housing 107, and the second crank shaft 153 and the connecting plate 157 which form the second crank mechanism are mounted on the crank cap 163. Moreover, when the crank cap 163 is fitted over the opening 107*b*, the recess 153*b* formed in the disk-like portion 153*a* of the second crank shaft 153 is engaged with the protruding end 126*a* of the eccentric pin 126 of the first crank shaft 125, so that the second crank mechanism is mechanically interconnected with the first crank mechanism. With this construction, the second crank mechanism can be mounted simply by mounting the crank cap 163 on the opening 107*b*. Thus, according to this embodiment, mounting of the second crank mechanism is facilitated and ease of assembly can be increased.

Further, in the case of the construction, like this embodiment, in which the second crank shaft 153 and the connecting plate 157 which form the second crank mechanism are mounted on the crank cap 163, a crank cap which is designed and provided exclusively for the purpose of closing the opening 107*b*, or a crank cap without the second crank mechanism, can be mounted in place of the crank cap 163 with the second crank mechanism. In this manner, shift from the hammer 101 with the dynamic vibration reducer 171 to a low-end model without the dynamic vibration reducer 171 can be readily realized.

Further, the opening 107*b* formed in the gear housing 107 is designed and provided as a hole through which the first crank mechanism is mounted in the gear housing 107. Further, an upper region above the first crank mechanism exists as free space. In this embodiment, the second crank mechanism is disposed by utilizing this free space, so that the second crank mechanism can be installed without changing the outside dimensions of the existing electric hammer 101.

Further, the slide sleeve 151 that is slidably fitted on the cylinder 141 has a cylindrical body elongated in the axial direction of the hammer bit or in the sliding direction. With this construction, the sliding movement of the slide sleeve 151 can be stabilized. As a result, a simple construction in which the rods 159 push the slide sleeve 151 can be applied.

Second Embodiment of the Invention

Figure 8:
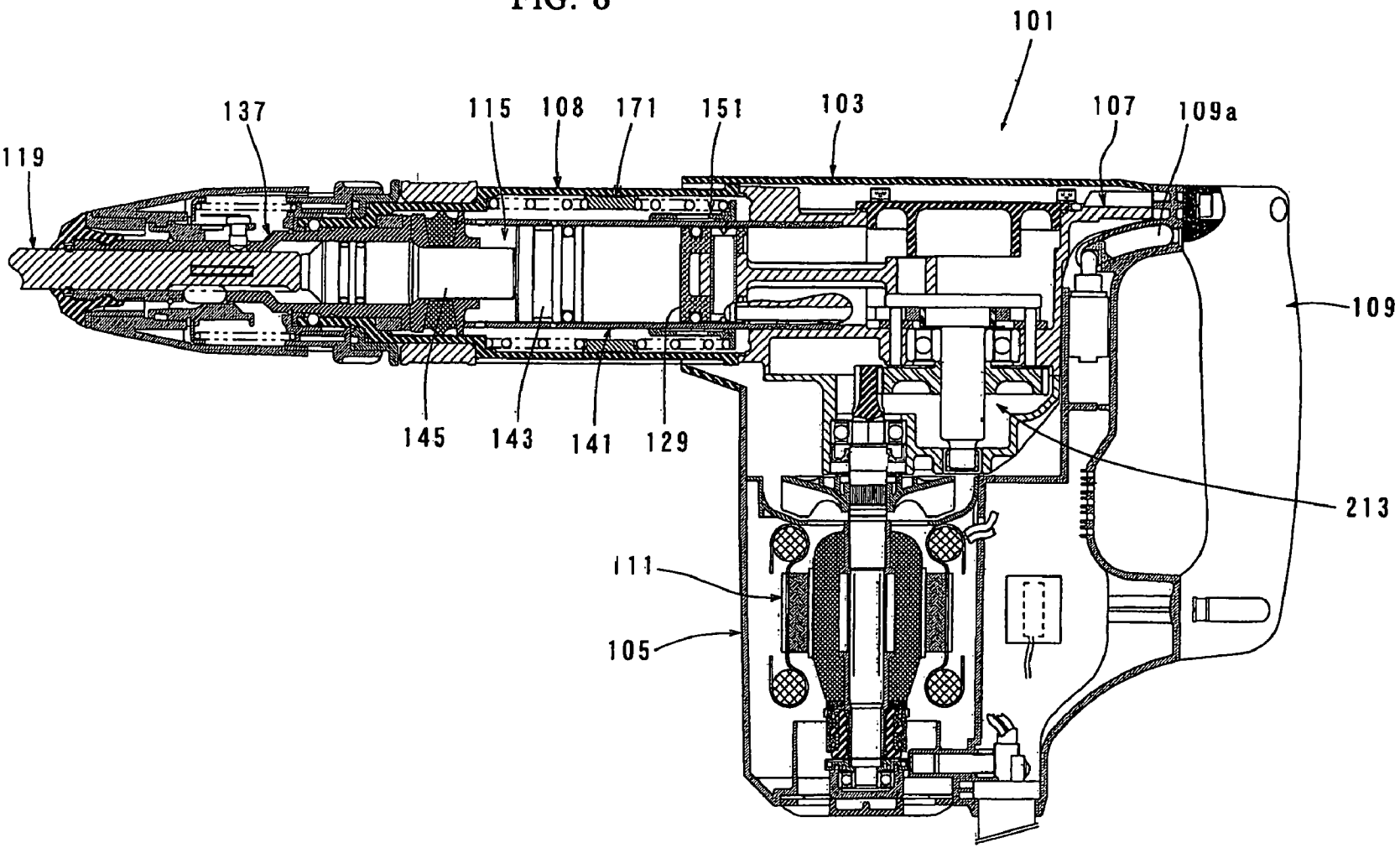
FIG. 8 is a sectional side view schematically showing an entire electric hammer according to a second embodiment of this invention.
Figure 9:
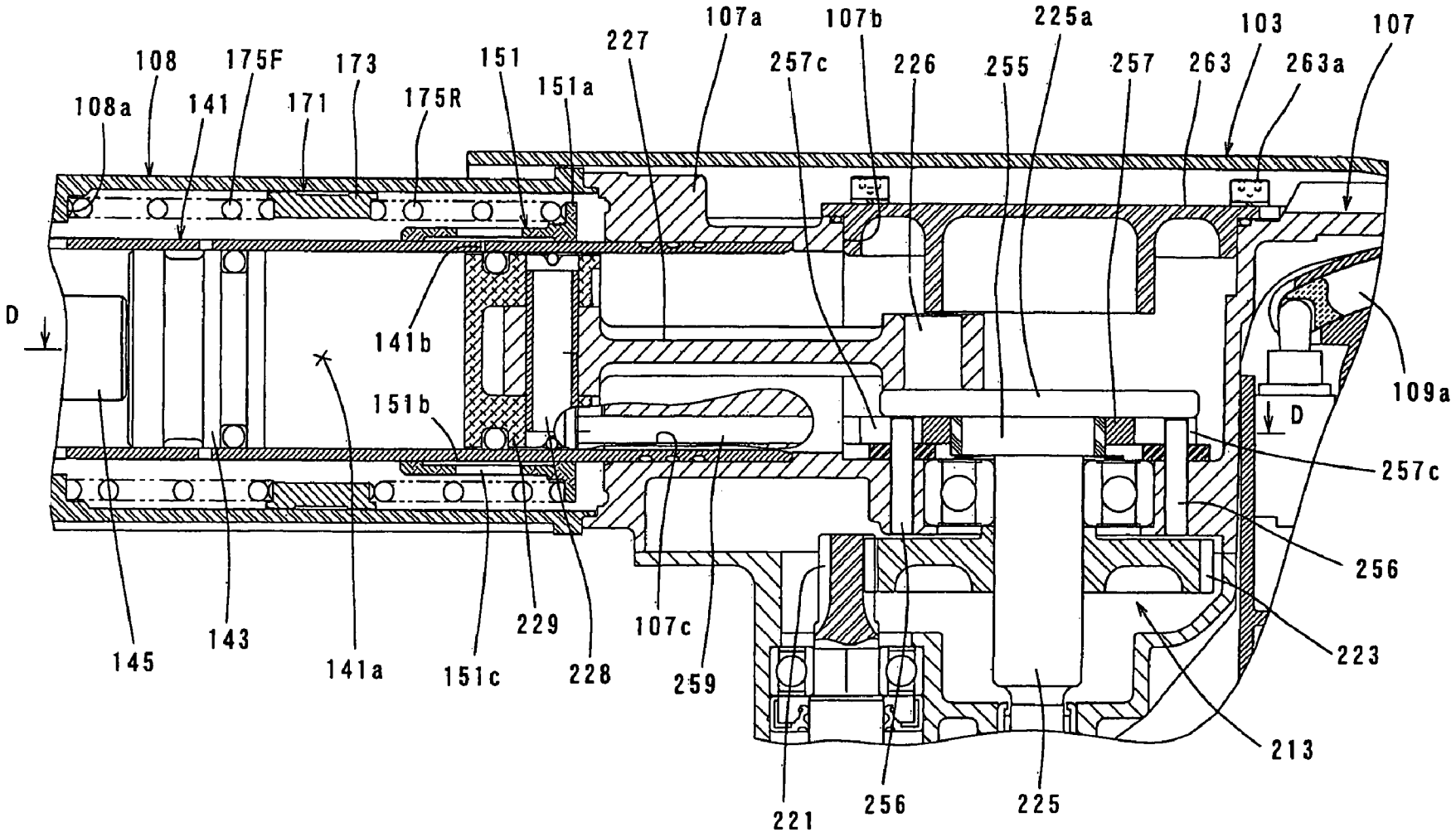
FIG. 9 is an enlarged sectional view showing an essential part of the hammer.
Figure 10:
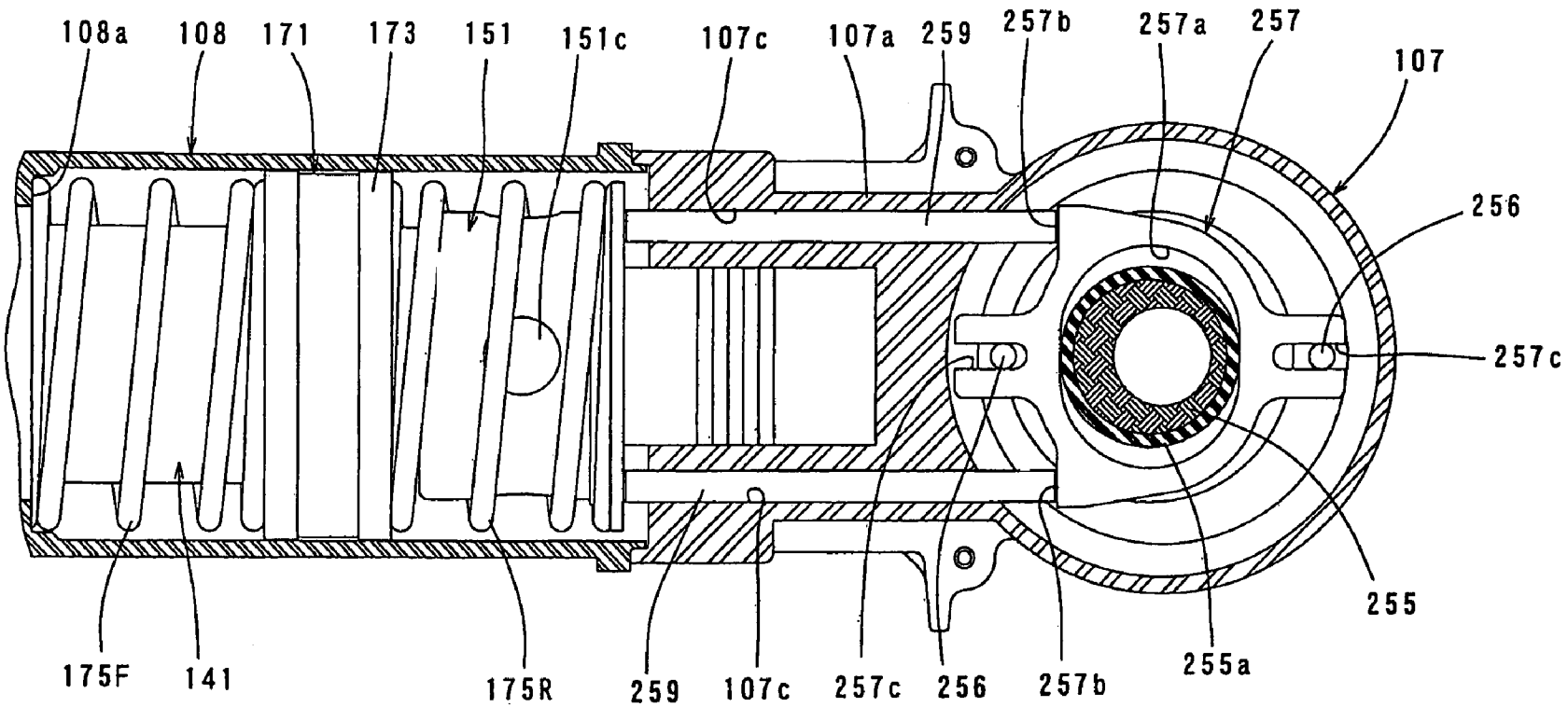
FIG. 10 is a sectional view taken along line D-D in FIG. 9.

A second embodiment of the present invention is now described with reference to FIGS. 8 to 10. FIG. 8 is a sectional view showing an entire electric hammer 101 according to this embodiment. FIG. 9 is an enlarged sectional view showing an essential part of the hammer. FIG. 10 is a sectional view taken along line D-D in FIG. 9. This embodiment is a modification to the mechanical vibration mechanism for forcibly vibrating the dynamic vibration reducer 171 in the electric hammer 101 having the dynamic vibration reducer 171 that reduces vibration of the body 103. In this embodiment, forced vibration of the dynamic vibration reducer 171 is effected by the second crank mechanism which is mounted on a motion converting mechanism 213 that drives the striker 143, and the second motion converting mechanism 116 in the above-mentioned first embodiment is omitted. In the other points, it has the same construction as the first embodiment. Components or elements in this embodiment which are substantially identical to those in the first embodiment are given like numerals as in the first embodiment and will not be described or only briefly described.

The motion converting mechanism 213 according to this embodiment includes the first crank mechanism that drives the striker 143 and the second crank mechanism that drives the dynamic vibration reducer 171. The first crank mechanism mainly includes a driving gear 221 that is rotated in a horizontal plane by the driving motor 111 (see FIG. 8), a driven gear 223 that engages with the driving gear 221, a crank shaft 225 that rotates together with the driven gear 223, a crank plate 225*a* that is integrally formed on the upper end of the crank shaft 225, a connecting member in the form of a crank arm 227 that is loosely connected at its one end to the crank plate 225*a* via an eccentric pin 226 in a position displaced a predetermined distance from the center of rotation of the crank plate 225*a*, and a driving element in the form of a piston 229 mounted to the other end of the crank arm 227 via a connecting shaft 228. The second crank mechanism mainly includes an eccentric shaft portion 255 integrally formed with the crank shaft 225, a connecting plate 257 that is caused to reciprocate in the axial direction of the hammer bit 119 by rotation of the eccentric shaft portion 255, and an actuating member in the form of right and left straight rods 259 that linearly move together with the connecting plate 257 and move the slide sleeve 151 forward.

The eccentric shaft portion 255 has a circular shape of which center is displaced a predetermined distance from the center of rotation of the crank shaft 225. The connecting plate 257 is engaged with a ring 255*a* that is fitted on the eccentric shaft portion 255, via an elliptical hole 257*a* elongated in a direction transverse to the axial direction of the hammer bit. Further, the connecting plate 257 is guided by front and rear guide pins 256 mounted to the gear housing 107 in such a manner as to linearly move. Further, front and rear guide grooves 257*c* are formed in the connecting plate 257 and extend in the axial direction of the hammer bit, and the guide grooves 257*c* are slidably engaged with the associated guide pins 256. As shown in FIG. 10, the right and left rods 259 are slidably fitted into respective guide holes 107*c* that are formed through the cylinder holding portion 107*a* of the gear housing 107 in the axial direction of the hammer bit. One axial end (rear end) of each of the rods 259 is held in contact with a planar front surface 257*b* of the connecting plate 257, while the other axial end (front end) is held in contact with a rear end surface of the slide sleeve 151 of the dynamic vibration reducer 171. The opening 107*b* is formed in the gear housing 107 above the motion converting mechanism 213 and covered by a crank cap 263 which is removably fastened to the gear housing 107 by screws 263*a*.

According to this embodiment having the above-described construction, like the first embodiment, during hammering operation by the hammer bit 119, the weight 173 is actively driven via the biasing springs 175F, 175R by linearly moving the slide sleeve 151 via the second crank mechanism. Specifically, vibration which is caused in the body 103 in the axial direction of the hammer bit during hammering operation can be effectively reduced or alleviated by forced vibration of the dynamic vibration reducer 171. Particularly, in the motion converting mechanism 213 in this embodiment, the second crank mechanism that forcibly vibrates the dynamic vibration reducer 171 is mounted on the first crank mechanism that drives the striker 143. Specifically, the eccentric shaft portion 255 is disposed on the crank shaft 225, and the slide sleeve 151 is driven via the connecting plate 257 that engages with the eccentric shaft portion 255 and via the rods 259. With this construction, according to this embodiment, the number of parts for driving the slide sleeve 151 can be reduced compared with the first embodiment.

Further, in the above-described embodiments, the electric hammer 101 is described as a representative example of the impact tool. However, naturally, the present invention can also be applied to a hammer drill in which the hammer bit 119 can perform a striking movement in its axial direction and a rotation around its axis.

Third Embodiment of the Invention

Figure 11:
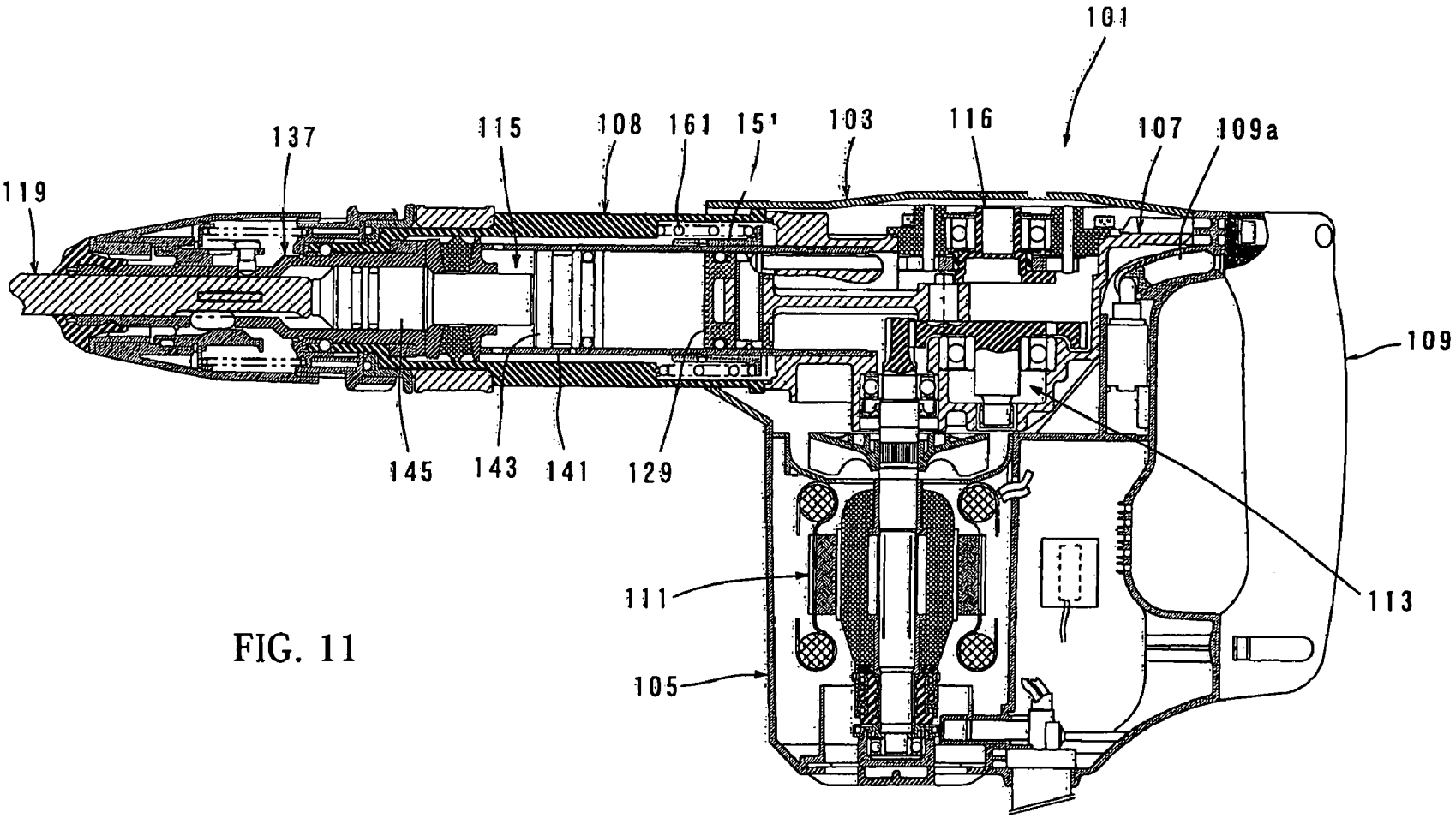
FIG. 11 is a sectional side view schematically showing an entire electric hammer according to a third embodiment of this invention.
Figure 12:
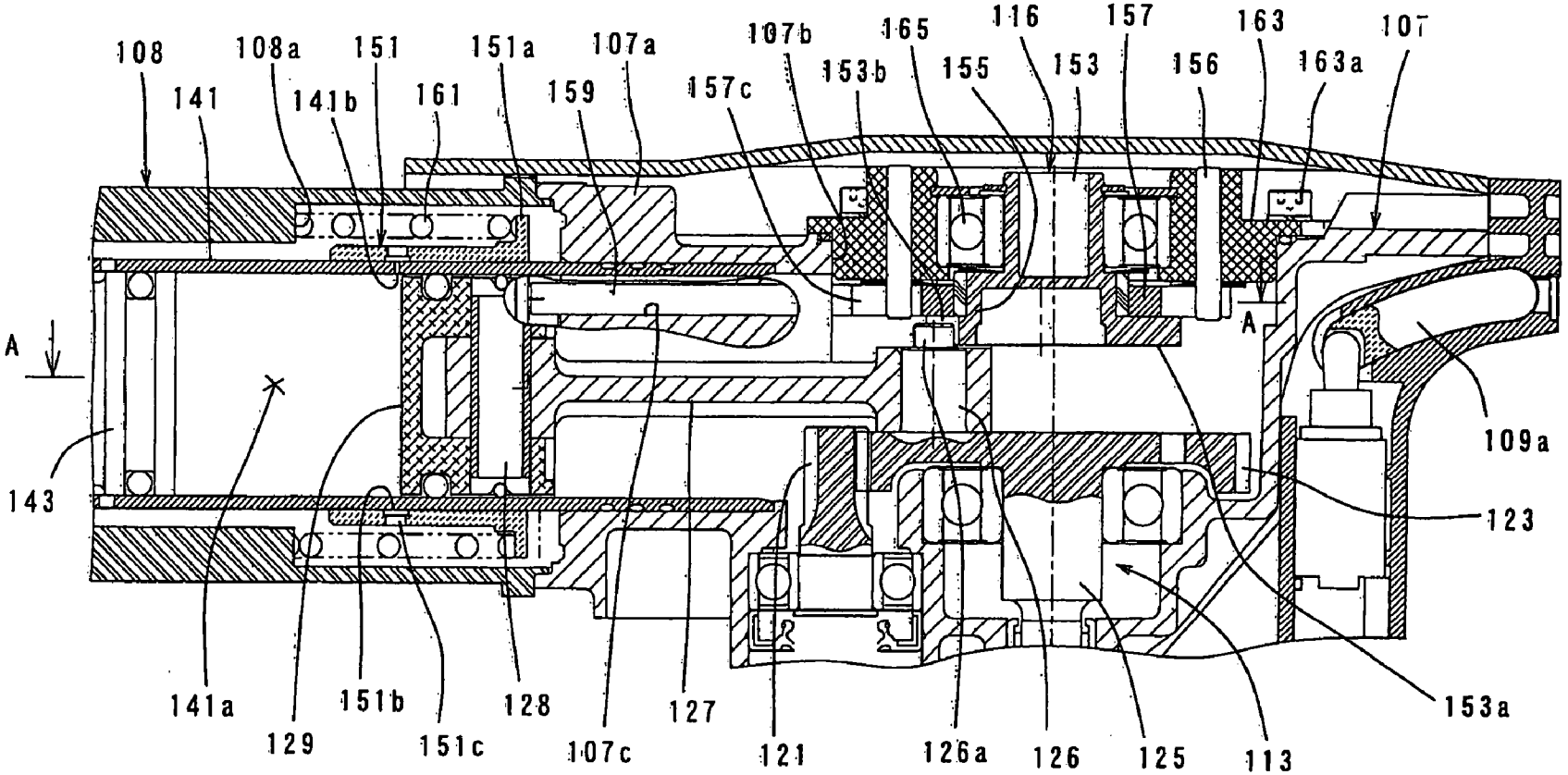
FIG. 12 is an enlarged sectional view showing an essential part of the hammer in the state in which an air vent of an air chamber is open.
Figure 13:
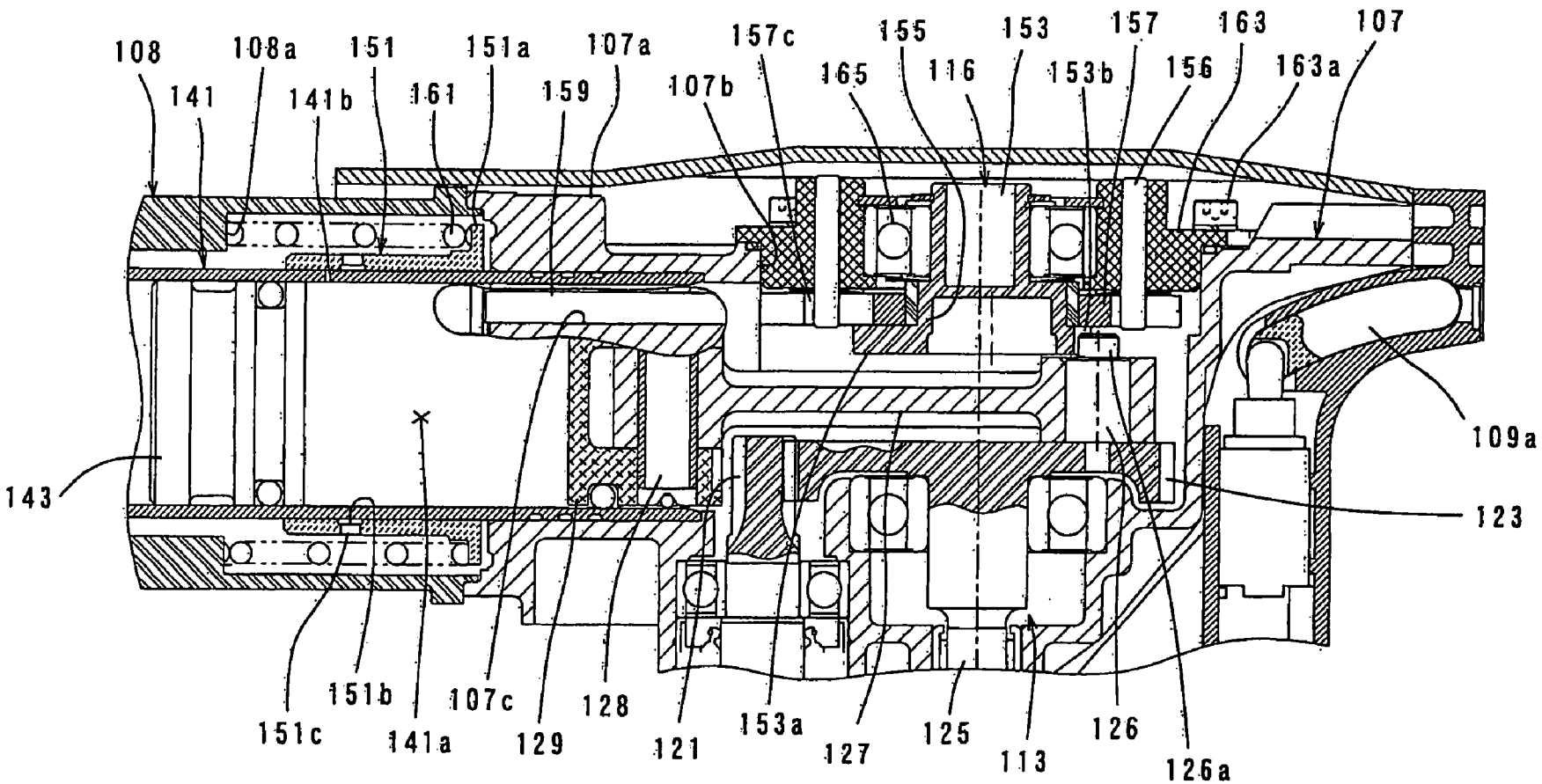
FIG. 13 is an enlarged sectional view showing an essential part of the hammer in the state in which the air vent of the air chamber is closed.
Figure 14:
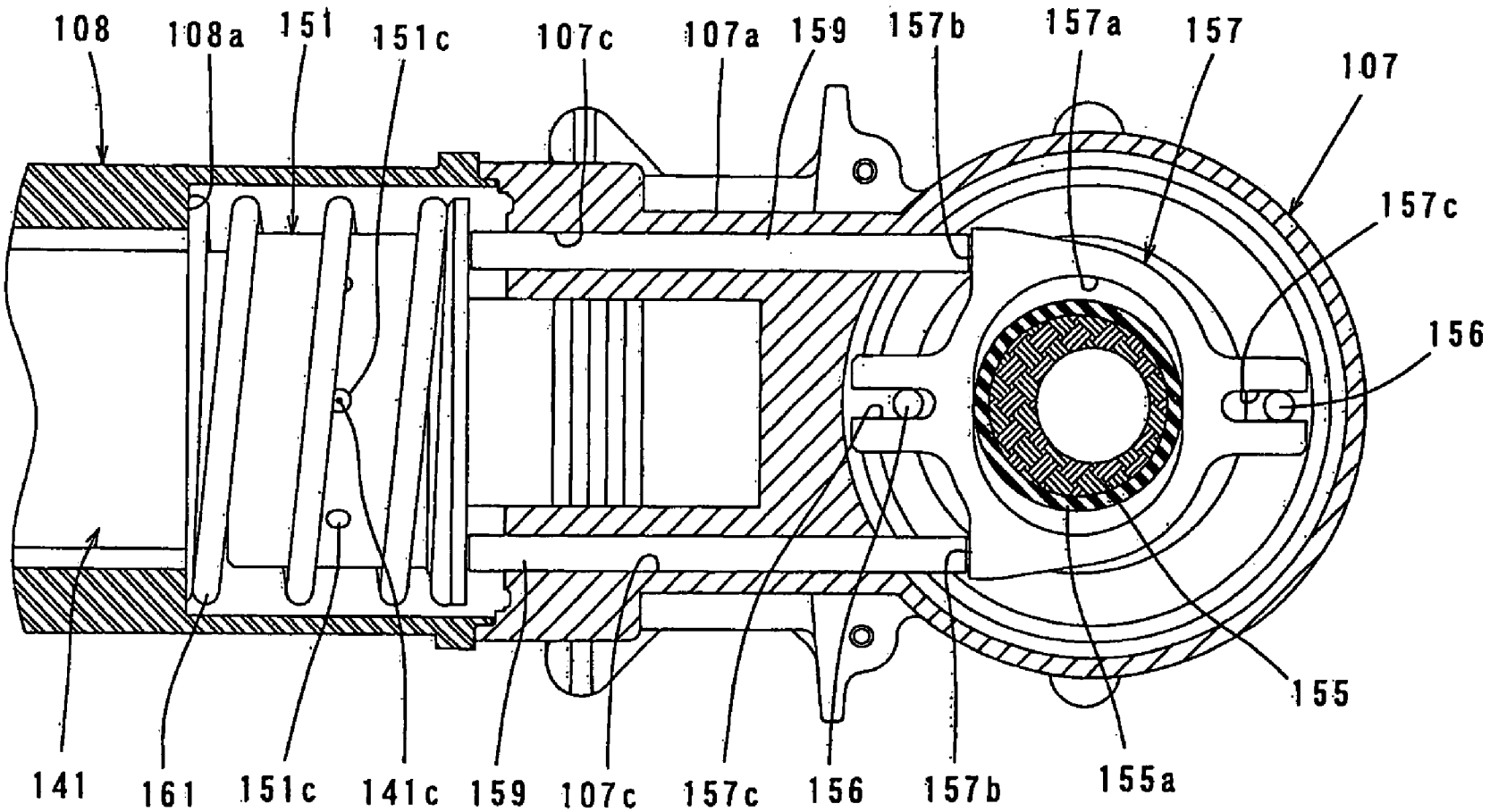
FIG. 14 is a sectional view taken along line A-A in FIG. 12.

A third embodiment of the present invention is now described with reference to FIGS. 11 to 14. FIG. 11 shows an entire electric hammer 101 as a representative embodiment of the impact tool according to the present invention. FIGS. 12 and 13 are enlarged sectional views each showing an essential part of the hammer, in the open state and the closed state of an air vent of an air chamber, respectively. FIG. 14 is a sectional view taken along line A-A in FIG. 12.

As shown in FIG. 11, the hammer 101 of this embodiment includes a body 103, a hammer bit 119 detachably coupled to the tip end region (on the left side as viewed in FIG. 11) of the body 103 via a tool holder 137, and a handgrip 109 that is connected to the body 103 on the side opposite the hammer bit 119 and designed to be held by a user. The body 103 and the hammer bit 119 are features that correspond to the "tool body" and the "tool bit", respectively, according to the present invention. The hammer bit 119 is held by the tool holder 137 such that it is allowed to reciprocate with respect to the tool holder 137 in its axial direction and prevented from rotating with respect to the tool holder 137 in its circumferential direction. In the present embodiment, for the sake of convenience of explanation, the side of the hammer bit 119 is taken as the front side and the side of the handgrip 109 as the rear side.

The body 103 includes a motor housing 105 that houses a driving motor 111, and a gear housing 107 that houses a first motion converting mechanism 113 and a second motion converting mechanism 116, and a barrel housing 108 that houses a striking mechanism 115. The rotating output of the driving motor 111 is appropriately converted into linear motion via the first motion converting mechanism 113 and transmitted to the striking element 115. Then, an impact force is generated in the axial direction of the hammer bit 119 via the striking element 115. Further, the rotating output of the driving motor 111 is transmitted to the second motion converting mechanism 116 via the first motion converting mechanism 113 and converted into linear motion by the second motion converting mechanism 116. The linear motion is inputted into a slide sleeve 151 that opens and closes an air vent 141*b* of an air chamber 141*a* which will be described below, as a driving force for sliding the slide sleeve 151. The driving motor 111 is a feature that corresponds to the "motor" according to this invention. Further, a slide switch 109*a* is provided on the handgrip 109 and can be slid by the user to drive the driving motor 111.

As shown in FIGS. 12 and 13, the first motion converting mechanism 113 includes a driving gear 121 that is rotated in a horizontal plane by the driving motor 111 (see FIG. 11), a first crank shaft 125 integrally having a driven gear 123 that engages with the driving gear 121, a connecting member in the form of a crank arm 127 that is loosely connected at its one end to the first crank shaft 125 via an eccentric pin 126 in a position displaced a predetermined distance from the center of rotation of the first crank shaft 125, and a driving element in the form of a piston 129 mounted to the other end of the crank arm 127 via a connecting shaft 128. The first crank shaft 125, the eccentric pin 126, the crank arm 127 and the piston 129 form a first crank mechanism.

As shown in FIG. 11, the striking mechanism 115 includes a striking element in the form of a striker 143 that is slidably disposed within the bore of the cylinder 141, and an intermediate element in the form of an impact bolt 145 that is slidably disposed within the tool holder 137 and transmits the kinetic energy of the striker 143 to the hammer bit 119. An air chamber 141*a* is defined between the piston 129 and the striker 143 within the cylinder 141. The striker 143 is driven via the action of an air spring of the air chamber 141*a* of the cylinder 141 which is caused by sliding movement of the piston 129. The striker 143 then collides with (strikes) the intermediate element in the form of the impact bolt 145 that is slidably disposed within the tool holder 137 and transmits the striking force to the hammer bit 119 via the impact bolt 145. The cylinder 141 is disposed coaxially with the hammer bit 119. Therefore, the piston 129 and the striker 143 linearly move on the same axis as the hammer bit 119. Further, the cylinder 141 is inserted from the front into the bore of a cylindrical cylinder holding portion 107*a* formed in the front region of the gear housing 107 and held there, and is housed within the barrel housing 108 joined to the gear housing 107.

The air chamber 141*a* serves to drive the striker 143 via the action of the air spring and communicates with the outside via one or more pressure regulating air vents 141*b* that are formed in the cylinder 141 and radially extend through it. The air vent 141*b* is a feature that corresponds to the "ventilation part" according to this invention. A slide sleeve 151 is disposed outside the cylinder 141 and serves to open and close the air vent 141*b*. The slide sleeve 151 is a feature that corresponds to the "ventilation part opening-closing member" according to this invention. The slide sleeve 151 is fitted on the cylinder 141 such that it can slide in the axial direction of the hammer bit, and the slide sleeve 151 is slid by the second motion converting mechanism 116. The slide sleeve 151 has a ring-like groove 151*b* and a plurality of communication holes 151*c*. The ring-like groove 151*b* is formed in the inner wall surface of the slide sleeve 151, having a predetermined width in the axial direction and extending in the circumferential direction of the slide sleeve 151. The communication holes 151*c* radially extend through the slide sleeve 151 in such a manner as to provide communication between the groove 151*b* and the outside. When the slide sleeve 151 slides on the cylinder 141 and is placed in a region in which the ring-like groove 151*b* faces the air vent 141*b* of the cylinder 141, the slide sleeve 151 opens the air vent 141*b*. On the other hand, when the slide sleeve 151 moves out of the region in which the ring-like groove 151*b* faces the air vent 141*b*, the slide sleeve 151 closes the air vent 141*b*.

The second motion converting mechanism 116 is disposed above the first motion converting mechanism 113. As shown in FIGS. 12 to 14, the second motion converting mechanism 116 mainly includes a second crank shaft 153 that is rotationally driven in a horizontal plane by rotation of the eccentric pin 126 of the first motion converting mechanism 113, an eccentric shaft portion 155 integrally formed with the second crank shaft 153, a connecting member in the form of a connecting plate 157 that is caused to reciprocate in the axial direction of the hammer bit by rotation of the eccentric shaft portion 155, an actuating member in the form of right and left straight rods 159 that linearly move together with the connecting plate 157 and move the slide sleeve 151 forward, and a pressing spring 161 that biases the slide sleeve 151 in such a manner as to move the slide sleeve 151 rearward. The second crank shaft 153, the eccentric shaft portion 155 and the connecting plate 157 form the second crank mechanism which is a feature that corresponds to the "second crank mechanism" according to this invention.

The second crank shaft 153 is coaxially opposed to the first crank shaft 125. The second crank shaft 153 has a disk-like portion 153*a* on its axial lower end. A recess (groove) 153*b* is formed in the lower surface of the disk-like portion 153*a* in a position displaced from the center of rotation of the second crank shaft 153. The recess 153*b* is engaged with a protruding end 126*a* of the eccentric pin 126 of the first motion converting mechanism 113. The recess 153*b* and the protruding end 126*a* are features that correspond to the "concave portion" and the "convex portion", respectively, according to this invention. Specifically, the second crank shaft 153 is rotationally driven by a driving force that is inputted from the first crank shaft 125 via engagement between the recess 153*b* and the protruding end 126. An opening 107*b* to be used for mounting the first motion converting mechanism 113 is formed in the gear housing 107 above the first motion converting mechanism 113. The second crank mechanism is mounted on a crank cap 163 which is removably fitted over the opening 107*b*. The crank cap 163 is a feature that corresponds to the "covering member" according to this invention.

The second crank shaft 153 is rotatably supported on the crank cap 163 via a bearing 165. The eccentric shaft portion 155 has a circular shape of which center is displaced a predetermined distance from the center of rotation of the second crank shaft 153. The connecting plate 157 is engaged with a ring 155*a* that is fitted on the eccentric shaft portion 155, via an elliptical hole 157*a* elongated in a direction transverse to the axial direction of the hammer bit. Further, the connecting plate 157 is guided by front and rear guide pins 156 mounted to the crank cap 163 in such a manner as to linearly move in the axial direction of the hammer bit. Further, front and rear guide grooves 157*c* are formed in the connecting plate 157 and extend in the axial direction of the hammer bit, and the guide grooves 157*c* are slidably engaged with the associated guide pins 156. As shown in FIG. 14, the right and left rods 159 are slidably fitted into respective guide holes 107*c* that are formed through the cylinder holding portion 107*a* of the gear housing 107 in the axial direction of the hammer bit. One axial end (rear end) of each of the rods 159 is held in contact with a planar front surface 157*b* of the connecting plate 157, while the other axial end (front end) is held in contact with a rear end surface of the slide sleeve 151. The pressing spring 161 is a coil spring disposed outside the slide sleeve 151. One axial end (rear end) of the pressing spring 161 is held in contact with a flange 151*a* of the slide sleeve 151, while the other axial end (front end) is held in contact with a stepped surface 108*a* of the barrel housing 108.

The second crank shaft 153 and the connecting plate 157 which form the second crank mechanism are mounted to the crank cap 163 before the crank cap 163 is mounted on the opening 107*b* of the gear housing 107. The connecting plate 157 is held between the inner wall surface of the crank cap 163 and the disk-like portion 153*a* of the second crank shaft 153, so that the connecting plate 157 is prevented from moving in the axial direction of the second crank shaft 153. The crank cap 163 with the second crank shaft 153 and the connecting plate 157 mounted thereto is fitted over the opening 107*b* from outside (above) the gear housing 107 and fastened to the gear housing 107 by a plurality of screws 163*a*. At this time, the recess 153*b* formed in the disk-like portion 153*a* of the second crank shaft 153 is engaged with the protruding end 126*a* of the eccentric pin 126 of the first crank mechanism which is already mounted within the gear housing 107, and the rear end of the rod 159 is brought into contact with the front surface 157*b* of the connecting plate 157. Thus, the first and second crank mechanisms are assembled in a mechanically interconnected manner such that the rotating force can be transmitted.

Operation of the hammer 101 having the above-described construction is now explained. When the driving motor 111 (shown in FIG. 11) is driven, the rotating output of the driving motor 111 causes the driving gear 121 to rotate in the horizontal plane. When the driving gear 121 rotates, the first crank shaft 125 revolves in the horizontal plane via the driven gear 123 that engages with the driving gear 121. Then, the piston 129 is caused to linearly slide within the cylinder 141 via the crank arm 127. Thus, the striker 143 reciprocates within the cylinder 141 and collides with (strikes) the impact bolt 145 by the action of the air spring function within the cylinder 141 as a result of the sliding movement of the piston 129. The kinetic energy of the striker 143 which is caused by the collision with the impact bolt 145 is transmitted to the hammer bit 119. Thus, the hammer bit 119 performs a striking movement in its axial direction, and the hammering operation is performed on the workpiece.

During the above-mentioned hammering operation, the slide sleeve 151 controls opening and closing of the air vent 141*b* of the cylinder 141 via the second motion converting mechanism 116. Specifically, when the second crank shaft 153 of the second motion converting mechanism 116 is rotated via the eccentric pin 126 of the first motion converting mechanism 113, the eccentric shaft portion 155 of the second crank shaft 153 is caused to rotate in a horizontal plane. As a result, the connecting plate 157 engaged with the eccentric shaft portion 155 is caused to reciprocate in the axial direction of the hammer bit 119. When the connecting plate 157 moves forward, the rods 159 move the slide sleeve 151 forward against the biasing force of the pressing spring 161, while, when the connecting plate 157 moves rearward, the rods 159 move the slide sleeve 151 rearward by the biasing force of the pressing spring 161. Opening and closing of the air vent 141*b* via the ring-like groove 151*b* and the communication holes 151*c* are effected by this forward and rearward movement of the slide sleeve 151.

Now, control of opening and closing of the air vent 141*b* is now explained. In this embodiment, the maximum retracted end or the rearmost position to which the piston 129 can be moved is defined as the top dead center, while the maximum advanced end or the front position to which the piston 129 can be moved is defined as the bottom dead center. When the crank angle of the first crank mechanism is 0°, the piston 129 is placed in the top dead center, while, when the crank angle is 180°, the piston 129 is placed in the bottom dead center. Further, in this embodiment, the opening and closing timing of the slide sleeve 151 is set such that, when the crank angle is in the range of about 135° to 220°, the air vent 141*b* of the air chamber 141*a* is opened, while, otherwise or when the crank angle is in the range of about 0° to 135° or 220° to 360°, the air vent 141*b* is closed. FIG. 12 shows the state in which the air vent 141*b* is open and FIG. 13 shows the state in which the air vent 141*b* is closed.

The air chamber 141*a* has a minimum capacity when the piston 129 is moved a crank angle of about 70° to 87° from the top dead center. Specifically, the piston 129 is placed closest to the striker 143 so that air within the air chamber 141*a* is compressed to a maximum extent. Thereafter, the striker 143 is caused to move forward by pressure of the high-pressure compressed air. When the crank angle is about 180°, the striker 143 strikes the hammer bit 119 via the impact bolt 145. After the striking movement, the striker 143 is caused to move rearward by rebound of the striking movement and by pressure difference (suction force) between the pressure within the air chamber 141*a* which acts upon the rear end surface of the striker 143 and the outside pressure (substantially the atmospheric pressure).

In this embodiment, the period between the instant when the striker 143 starts moving forward and the instant when the striker 143 returns to the initial position after colliding with the hammer bit 119 is defined as one cycle. The slide sleeve 151 starts opening the air vent 141*b* at the crank angle of about 137° and then holds the open state in a predetermined angle range. Thereafter, the slide sleeve 151 closes the air vent 141*b* at the crank angle of about 220°. Specifically, according to this embodiment, the times when the slide sleeve 151 opens and closes the air vent 141*b* can be arbitrarily set in the relationship with the position of the striker 143 (the piston 129). Specifically, such times can be set such that, during forward movement (striking movement) of the striker 143, the air vent 141*b* is opened in the position where (at the time when) high-pressure pressurized air within the air chamber 141*a* can provide optimum string speed for the striker 143. Further, during rearward movement of the striker 143, the air vent 141*b* is closed in the position where (at the time when) the striker 143 can be acted upon by optimum suction force. As a result, performance of the electric hammer 101 can be improved. Further, the period (interval) during which the air vent 141*b* is open is determined by the width (in the axial direction of the hammer bit 119) of the ring-like groove 151*b* formed in the slide sleeve 151.

Further, according to this embodiment, in which the slide sleeve 151 is mechanically driven by the second crank mechanism, the times when the slide sleeve 151 opens and closes the air vent 141*b* can be easily adjusted by appropriately adjusting (setting) the position of the eccentric shaft portion 155 of the second crank mechanism in the direction of rotation with respect to the eccentric pin 126 of the first crank mechanism which drives the striker 143. Further, the period during which the air vent 141*b* is open can be appropriately adjusted by changing the width of the ring-like groove 151*b* formed in the slide sleeve 151. Specifically, according to this embodiment, the air vent 141*b* can be opened only when necessary and only during a necessary period. Further, with the construction in which the second crank mechanism is driven via the first crank mechanism, both the striker 143 and the slide sleeve 151 can be efficiently driven by the single driving motor 111.

Further, in this embodiment, the crank cap 163 is fitted over the opening 107*b* in order to close the opening 107*b* of the gear housing 107, and the second crank shaft 153 and the connecting plate 157 which form the second crank mechanism are mounted on the crank cap 163. Moreover, when the crank cap 163 is fitted over the opening 107*b*, the recess 153*b* formed in the disk-like portion 153*a* of the second crank shaft 153 is engaged with the protruding end 126*a* of the eccentric pin 126 of the first crank shaft 125, so that the second crank mechanism is mechanically interconnected with the first crank mechanism. With this construction, the second crank mechanism can be mounted simply by mounting the crank cap 163 on the opening 107*b*. Thus, according to this embodiment, mounting of the second crank mechanism is facilitated and ease of assembly can be increased.

The opening 107*b* formed in the gear housing 107 is designed and provided as a hole through which the first crank mechanism is mounted in the gear housing 107. Further, an upper region above the first crank mechanism exists as free space. In this embodiment, the second crank mechanism is disposed by utilizing this free space, so that the second crank mechanism can be installed without changing the outside dimensions of the existing electric hammer 101.

Fourth Embodiment of the Invention

Figure 15:
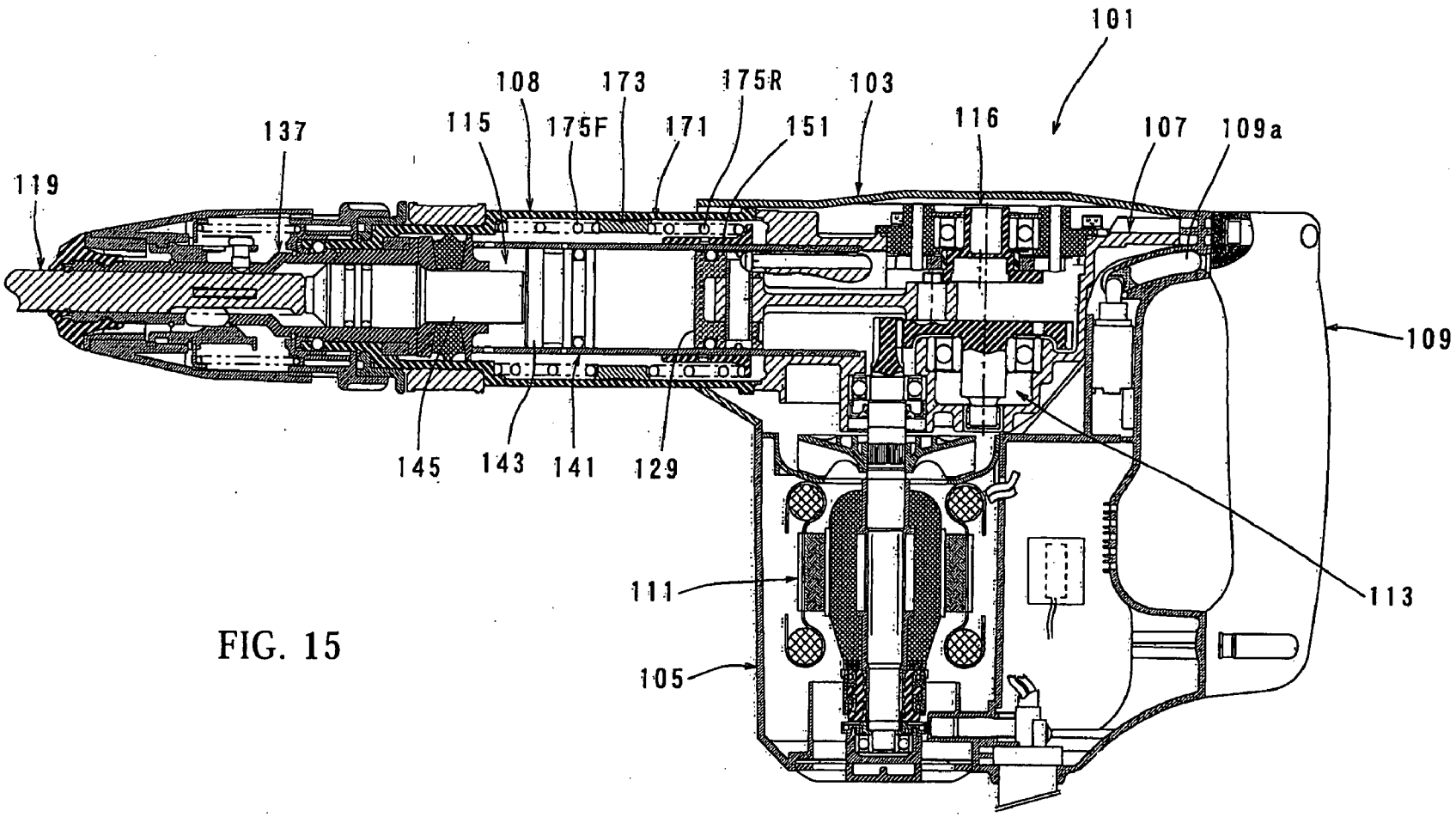
FIG. 15 is a sectional side view schematically showing an entire electric hammer according to a fourth embodiment of this invention.
Figure 16:
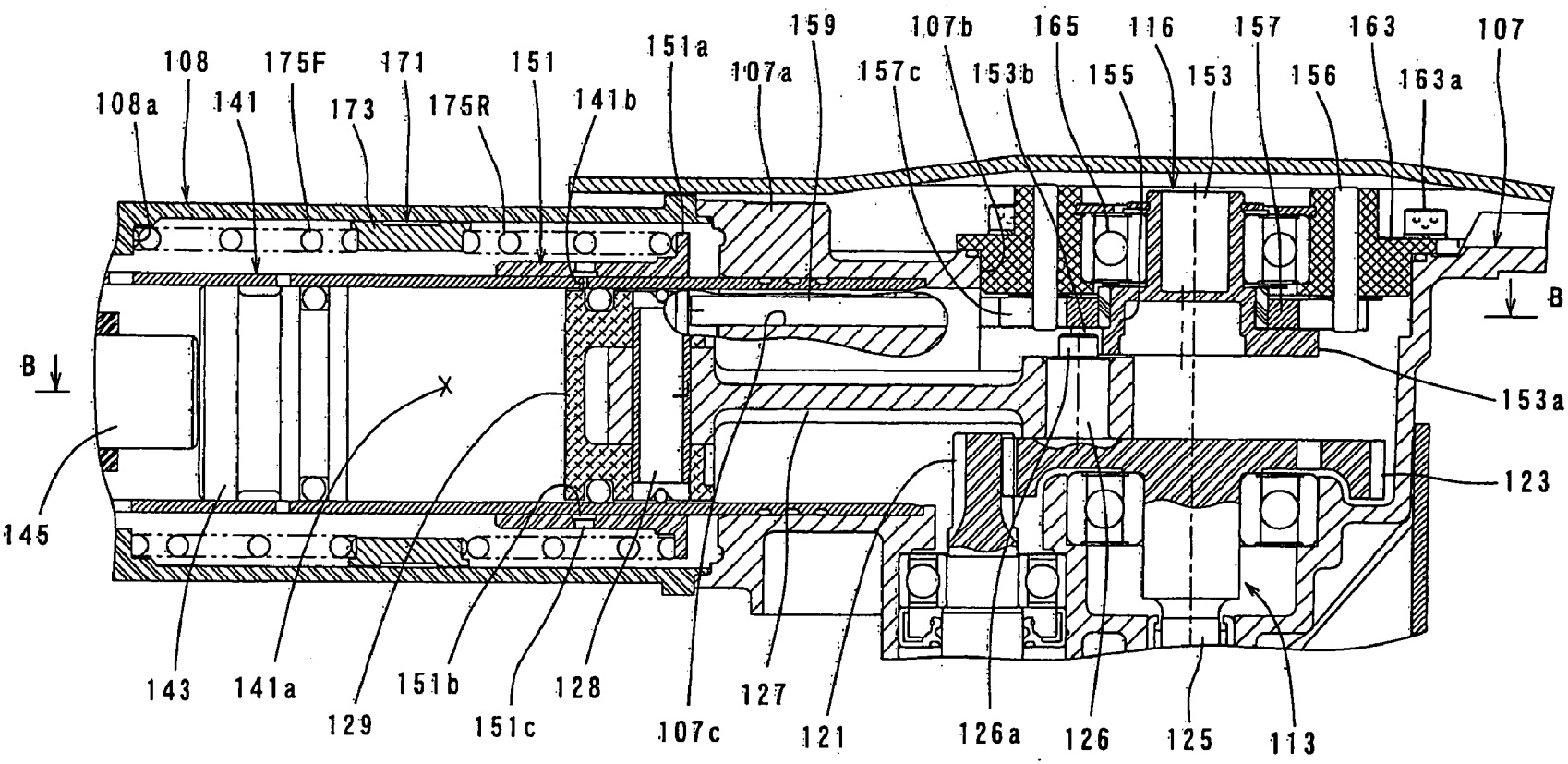
FIG. 16 is an enlarged sectional view showing an essential part of the hammer.
Figure 17:
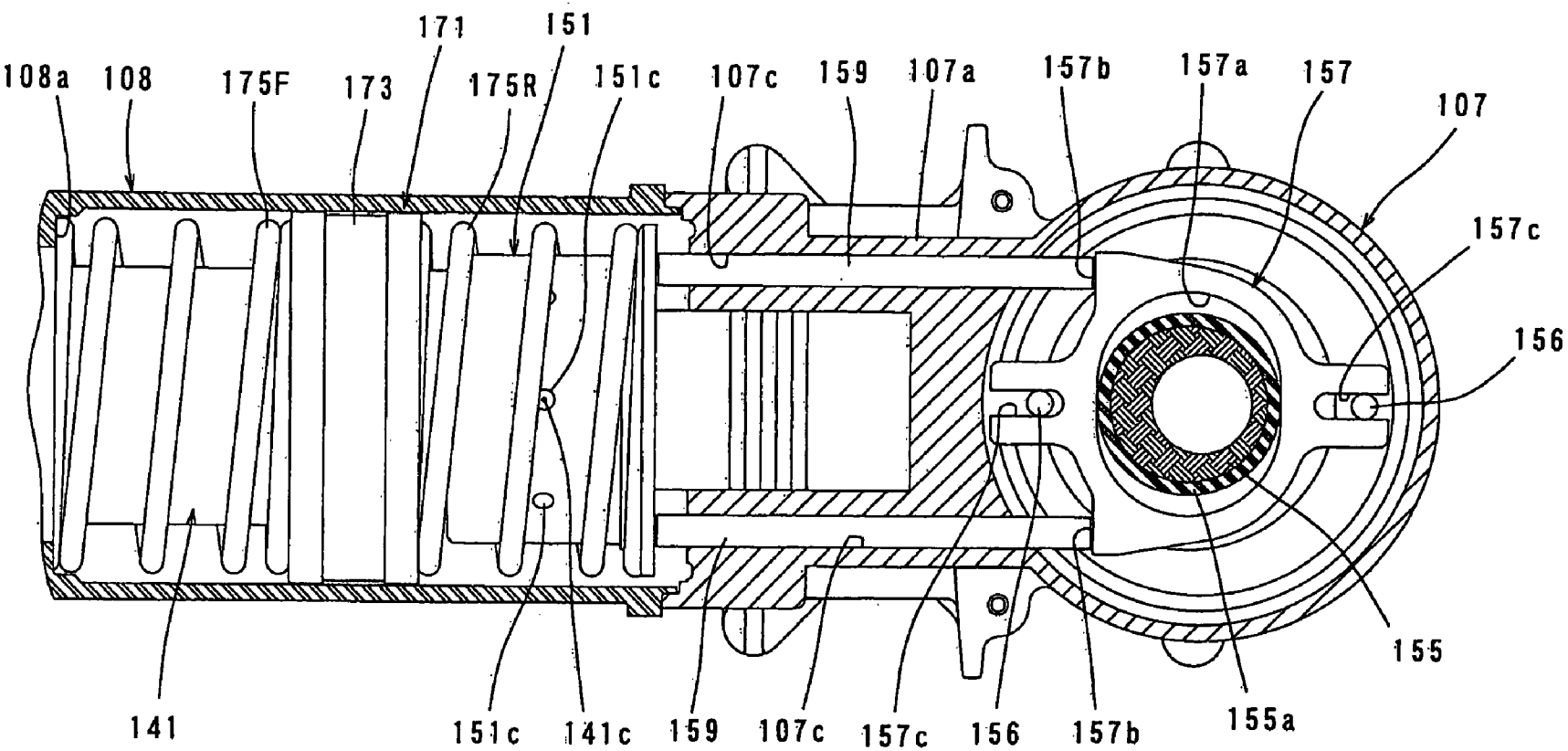
FIG. 17 is a sectional view taken along line B-B in FIG. 16.

A fourth embodiment of the present invention is now described with reference to FIGS. 15 to 17. FIG. 15 shows an entire electric hammer 101 according to this embodiment. FIG. 16 is an enlarged sectional view showing an essential part of the hammer. FIG. 17 is a sectional view taken along line B-B in FIG. 16. In this embodiment, a dynamic vibration reducer 171 for reducing vibration of the body 103 is installed in the hammer 101. Further, the slide sleeve 151 that linearly moves in the axial direction of the hammer bit in order to open and close the air vent 141*b* of the air chamber 141*a* is utilized as a vibration means for actively vibrating the dynamic vibration reducer 171. In the other points, it has the same construction as the first embodiment. Components or elements in this embodiment which are substantially identical to those in the first embodiment are given like numerals as in the first embodiment and will not be described or only briefly described. In this specification, forcibly vibrating the dynamic vibration reducer 171 is referred to as forced vibration.

The dynamic vibration reducer 171 is provided in the inner space of the barrel housing 108 and mainly includes a cylindrical weight 173 annularly arranged outside the cylinder 141 and front and rear biasing springs 175F, 175R disposed on the front and rear sides of the weight 173 in the axial direction of the hammer bit. The front and rear biasing springs 175F, 175R exert a spring force on the weight 173 in a direction toward each other when the weight 173 moves in the axial direction of the hammer bit 119.

The weight 173 is arranged such that its center (of gravity) coincides with the axis of the hammer bit 119 and can freely slide with its outer wall surface held in contact with the inner wall surface of the barrel housing 108. Further, the front and rear biasing springs 175F, 175R are formed by compression coil springs and, like the weight 173, they are arranged such that each of their centers coincides with the axis of the hammer bit 119. One end (rear end) of the rear biasing spring 175R is held in contact with a front surface of the flange 151*a* of the slide sleeve 151, while the other end (front end) is held in contact with the axial rear end of the weight 173. Further, one end (rear end) of the front biasing spring 175F is held in contact with the axial front end of the weight 173, while the other end (front end) is held in contact with the stepped surface 108*a* of the barrel housing 108. Therefore, in this embodiment, the rear biasing spring 175R also serves as a pressing spring for biasing the slide sleeve 151 rearward.

The dynamic vibration reducer 171 having the above-described construction serves to reduce impulsive and cyclic vibration caused during hammering operation (when the hammer bit 119 is driven). Specifically, the weight 173 and the biasing springs 175F, 175R serve as vibration reducing elements in the dynamic vibration reducer 171 and cooperate to passively reduce vibration of the body 103 of the hammer 101. Thus, the vibration of the body 103 in the hammer 101 can be effectively alleviated or reduced.

Further, in this embodiment, during hammering operation, when the eccentric shaft portion 155 of the second crank shaft 153 rotates in a horizontal plane, the connecting plate 157 engaged with the eccentric shaft portion 155 is caused to reciprocate in the axial direction of the hammer bit 119. When the connecting plate 157 moves forward, the slide sleeve 151 is pushed forward via the rod 159 and compresses the biasing springs 175F, 175R. On the other hand, when the connecting plate 157 moves rearward, the slide sleeve 151 is pushed rearward by the spring force of the biasing springs 175F, 175R. By this linear movement of the slide sleeve 151, the weight 173 of the dynamic vibration reducer 171 is actively driven via the biasing springs 175F, 175R and causes the dynamic vibration reducer 171 to be forcibly vibrated. Specifically, the slide sleeve 151 serves as a vibration means for forcibly vibrating the dynamic vibration reducer 171 by actively driving the weight 173 of the dynamic vibration reducer 171. Thus, the dynamic vibration reducer 171 serves as an active vibration reducing mechanism in which the weight 173 is actively driven. Therefore, the vibration which is caused in the body 103 during hammering operation can be further effectively reduced or alleviated. As a result, a sufficient vibration reducing function can be ensured even in operations of the type in which, although vibration reduction is highly required, only a small amount of vibration is inputted to the dynamic vibration reducer 171 and the dynamic vibration reducer 171 does not sufficiently function, particularly, for example, in an operation which is performed with the user's strong pressing force applied to the body 103 (force of pressing the hammer bit 119 against the workpiece).

As described above, according to this embodiment, the slide sleeve 151 can provide forced vibration of the dynamic vibration reducer 171 while maintaining the function of controlling opening and closing of the air vents 141*b* which is described in the first embodiment.

Further, in this embodiment, the weight 173 and the biasing springs 175F, 175R which form the dynamic vibration reducer 171 are annularly arranged outside the cylinder 141. Thus, the outer peripheral space of the cylinder 141 can be effectively utilized. Further, the weight 173 and the biasing springs 175F, 175R can be disposed such that their centers of gravity are placed on the axis of the hammer bit 119. As a result, a couple (force of lateral or vertical rotation around an axis extending transverse to the axial direction of the hammer bit) can be prevented from acting upon the body 103 when the weight 173 reciprocates.

Further, in this embodiment, the weight 173 is disposed such that it can slide in the axial direction of the hammer bit along the inner wall surface of the barrel housing 108. With this construction, the sliding movement of the weight 173 can be stabilized.

Further, in the above-described embodiments, the electric hammer 101 is described as a representative example of the impact tool. However, naturally, the present invention can also be applied to a hammer drill in which the hammer bit 119 can perform a striking movement in its axial direction and a rotation around its axis.

DESCRIPTION OF NUMERALS

101 electric hammer (impact tool)
103 body (tool body)
105 motor housing

107 gear housing
107*a* cylinder holding portion
107*b* opening
107*c* guide hole
108 barrel housing
108*a* stepped surface
109 handgrip
109*a* slide switch
111 driving motor (motor)
113 first motion converting mechanism (actuating mechanism)
115 striking mechanism (actuating mechanism)
116 second motion converting mechanism (vibration mechanism)
119 hammer bit (tool bit)
121 driving gear
123 driven gear
125 first crank shaft
126 eccentric pin
126*a* protruding end
127 crank arm
128 connecting shaft
129 piston (driving element)
137 tool holder
141 cylinder
141*a* air chamber
141*b* air vent
143 striker (striking element)
145 impact bolt (intermediate element)
151 slide sleeve (sliding element)
151*a* flange
151*b* space
151*c* communication hole
153 second crank shaft
153*a* disk-like portion
153*b* recess (concave portion)
155 eccentric shaft portion
155*a* ring
156 guide pin
157 connecting plate
157*a* elliptical hole
157*b* front surface
157*c* guide groove
159 rod
163 crank cap (covering member)
163*a* screw
165 bearing
171 dynamic vibration reducer
173 weight
175F, 175R biasing spring (elastic element)
213 motion converting mechanism
221 driving gear
223 driven gear
225 crank shaft
225*a* crank plate
226 eccentric pin
227 crank arm
228 connecting shaft
229 piston (driving element)
255 eccentric shaft portion
255*a* ring
256 guide pin
257 connecting plate
257*a* elliptical hole
257*b* front surface
257*c* guide groove
259 rod
263 crank cap
263*a* screw

What we claimed is:

1. An impact tool which performs a predetermined hammering operation on a workpiece by a striking movement of a tool bit in its axial direction, comprising:

a tool body, a cylinder housed within the tool body, a dynamic vibration reducer having a weight that linearly moves under a biasing force of an elastic element, wherein the dynamic vibration reducer reduces vibration of the tool body during hammering operation by the movement of the weight in the axial direction of the tool bit, and a mechanical vibration mechanism that actively drives the weight by applying external force other than vibration of the tool body to the weight via the elastic element, wherein:

the weight and the elastic element are disposed on the axis of the tool bit and between an inner wall surface of the tool body and an outer wall surface of the cylinder in such a manner as to cover at least part of the outer wall surface of the cylinder in the circumferential direction, and the mechanical vibration mechanism includes a sliding element that linearly moves in the axial direction of the tool bit in such a manner as to apply an external force to the elastic element.

2. The impact tool as defined in claim 1, further comprising an actuating mechanism that linearly drives the tool bit, wherein:

the actuating mechanism includes a motor, a striking element that linearly moves in the axial direction of the tool bit in such a manner as to cause the tool bit to linearly move, and a first crank mechanism that converts a rotating output of the motor into linear motion and thereby drives the striking element, and the mechanical vibration mechanism includes a second crank mechanism that converts rotation of the first crank mechanism into linear motion and thereby drives the sliding element.

3. The impact tool as defined in claim 2, further comprising:

an opening that is formed in the tool body and provided as a hole through which the first crank mechanism is mounted within the tool body, and a covering member that can be mounted on the opening from outside the tool body in such a manner as to close the opening, wherein:

the first crank mechanism has a crank shaft that is rotatably disposed within the tool body and faces the opening, the second crank mechanism has a crank shaft that is rotatably mounted to the covering member and opposed to the crank shaft of the first crank mechanism, a concave portion is formed in one of opposed ends of the crank shafts of the first and second crank mechanisms, and a convex portion is formed on the other of the opposed ends of the crank shafts and can engage with the concave portion, and when the covering member is mounted on the opening, the crank shaft of the first crank mechanism and the crank shaft of the second crank mechanism are interconnected by engagement between the concave portion and the convex portion such that rotation of the crank shaft of the first crank mechanism can be transmitted to the crank shaft of the second crank mechanism.

4. The impact tool as defined in claim 2, wherein the first crank mechanism includes a rotatable crank shaft having an eccentric portion in a position displaced from its center of rotation, and a connecting member that converts rotation of the eccentric portion into linear motion of the driving element, and the second crank mechanism includes a rotatable crank shaft having an eccentric portion in a position displaced from its center of rotation, and a connecting member that converts rotation of the eccentric portion into linear motion of the sliding element.

5. The impact tool as defined in claim 1, wherein the weight is disposed on the tool body such that the weight can move along the inner wall surface of the tool body in the axial direction of the tool bit.

* * * * *